US012630777B2

(12) United States Patent
Berman et al.

(10) Patent No.: US 12,630,777 B2
(45) Date of Patent: May 19, 2026

(54) LIQUID AND SEMISOLID LUBRICANT COMPOSITIONS, METHODS OF MAKING, AND USES THEREOF

(71) Applicants: UNIVERSITY OF NORTH TEXAS, Denton, TX (US); Board of Trustees of Illinois State University, Normal, IL (US)

(72) Inventors: Diana Berman, Denton, TX (US); Asghar Shirani, Denton, TX (US); Kent Chapman, Denton, TX (US); John Sedbrook, Normal, IL (US)

(73) Assignees: University of North Texas, Denton, TX (US); Board of Trustees of Illinois State University, Normal, IL (US)

( * ) Notice: Subject to any disclaimer, the term of this patent is extended or adjusted under 35 U.S.C. 154(b) by 0 days.

(21) Appl. No.: 18/894,418

(22) Filed: Sep. 24, 2024

(65) Prior Publication Data

US 2025/0101330 A1 Mar. 27, 2025

Related U.S. Application Data

(60) Provisional application No. 63/585,082, filed on Sep. 25, 2023.

(51) Int. Cl.
*C10M 101/04* (2006.01)
*C10M 113/10* (2006.01)
(Continued)

(52) U.S. Cl.
CPC ..... *C10M 101/04* (2013.01); *C10M 113/10* (2013.01); *C10M 117/04* (2013.01); *C10M 123/02* (2013.01); *C10N 2010/02* (2013.01); *C10N 2030/02* (2013.01); *C10N 2030/04* (2013.01); *C10N 2030/06* (2013.01); *C10N 2030/12* (2013.01); *C10N 2030/14* (2013.01); *C10N 2040/25* (2013.01)

(58) Field of Classification Search
CPC ..... C10M 101/04; C10M 113/10; C10M 117/04; C10M 123/02; C10M 105/34; C10M 105/24; C10M 2201/1036; C10M 2207/1253; C10M 2207/1293; C10N 2010/02; C10N 2030/02; C10N 2030/04; C10N 2030/06; C10N 2030/12; C10N 2030/14; C10N 2040/25; C10N 2050/10
See application file for complete search history.

(56) References Cited

U.S. PATENT DOCUMENTS 11,136,525 B2 * 10/2021 Berman ..... C10M 119/20
2005/0020455 A1 * 1/2005 Mapp ..... C10M 169/04 508/491

(Continued)

*Primary Examiner* — Ellen M Mcavoy
(74) *Attorney, Agent, or Firm* — Thomas Horstemeyer LLP

(57) ABSTRACT

In one aspect, the disclosure relates to lubricant compositions comprising an oil, a wax, or a combination thereof, wherein at least one of the oil or the wax comprises a very long chain fatty acid; and wherein at least one of the oil or the wax has been modified to increase a concentration of the very long chain fatty acid relative to a reference concentration of the very long chain fatty acid in the oil or the wax without the modification. In a further aspect, the VLC FA can include one or more of eicosenoic acid, erucic acid, or nervonic acid.

20 Claims, 27 Drawing Sheets

(51) Int. Cl.

| | |
|---|---|
| ***C10M 117/04*** | (2006.01) |
| ***C10M 123/02*** | (2006.01) |
| *C10N 10/02* | (2006.01) |
| *C10N 30/02* | (2006.01) |
| *C10N 30/04* | (2006.01) |
| *C10N 30/06* | (2006.01) |
| *C10N 30/12* | (2006.01) |
| *C10N 30/14* | (2006.01) |
| *C10N 40/25* | (2006.01) |

(56) References Cited

U.S. PATENT DOCUMENTS

| | | | | |
|---|---|---|---|---|
| 2010/0098959 | A1* | 4/2010 | Genet | C09D 5/086 428/467 |
| 2013/0234061 | A1* | 9/2013 | Davis | C10M 171/008 508/459 |
| 2016/0143872 | A1* | 5/2016 | Thevenieau | C11C 3/00 508/459 |
| 2016/0376526 | A1* | 12/2016 | Smith | C10M 105/24 508/539 |
| 2018/0340129 | A1* | 11/2018 | Wang | C10M 105/62 |
| 2020/0270646 | A1* | 8/2020 | Brück | C12P 7/42 |
| 2021/0115352 | A1* | 4/2021 | Berman | C10M 105/40 |
| 2021/0292675 | A1* | 9/2021 | Lewis | C10M 129/40 |
| 2022/0145206 | A1* | 5/2022 | McBride | C10M 125/22 |

* cited by examiner

| Lubricants | Oxidation |
|---|---|
| PAO10 | >120 minutes |
| PAO4 | >120 minutes |
| Pennycress | 41 minutes |
| Rapeseed | 38 minutes |
| Canola | 32 minutes |
| Jojoba | > 120 minutes |
| Castor | > 120 minutes |
| Lesquerella | 66 minutes |

| Mol% Composition | | |
|---|---|---|
| Fatty Acids | Pennycress-LE | Pennycress |
| C16:0 | 3.5 | 2.5 |
| C16:1 | 0.1 | 0.1 |
| C18:0 | 1.2 | 0.6 |
| C18:1 cis | 40.8 | 15.5 |
| C18:1 trans | 2.5 | 1.2 |
| C18:2 | 29.8 | 18.7 |
| C18:3 | 17.6 | 9.6 |
| C20:0 | 0.3 | 0.3 |
| C20:1 cis | 1.4 | 9.7 |
| C20:1 trans | 0 | 0.7 |
| C20:2 | 0.2 | 1.5 |
| C22:0 | 0 | 0.2 |
| C22:1 | 1.8 | 35.7 |
| C22:2 | 0 | 0.6 |
| C24:1 | 0.7 | 3 |
| C18:1-OH | | |
| C20:1-OH | | |
| C20:2-OH | | |

FIG. 5A

| Bio Lubricants | Oxidation |
|---|---|
| Pennycress-LE | 26 minutes |
| Pennycress | 41 minutes |

LIQUID AND SEMISOLID LUBRICANT COMPOSITIONS, METHODS OF MAKING, AND USES THEREOF

CROSS REFERENCE TO RELATED APPLICATIONS

This application claims priority to, and the benefit of, U.S. provisional application entitled "LIQUID AND SEMI-SOLID LUBRICANT COMPOSITIONS AND METHODS OF MAKING, AND USES THEREOF" having Ser. No. 63/585,082, filed Sep. 25, 2023, which is hereby incorporated by reference in its entirety.

BACKGROUND

In many industrial applications, energy is lost because of friction. Approximately 28% of fuel energy in passenger cars is lost overcoming friction in engine, transmission, and drive train parts. Lubrication can be used to enhance the performance and efficiency of two parts in motion by creating a thin film between them and reducing the heat generated by friction. Petroleum-based lubricants, used as is or with additives, form a major proportion of lubricants used in many applications due to their chemical and physical properties, but their toxicity poses a threat to the environment, and they are non-renewable. Therefore, there is a need for alternative lubricants that are more environmentally friendly and exhibit desirable wear and friction properties on par with, or better than, commercially available petroleum-based lubricants. These and other needs are satisfied by the present disclosure.

SUMMARY

In accordance with the purpose(s) of the disclosure, as embodied and broadly described herein, the disclosure, in one aspect, relates to lubricant compositions comprising an oil, a wax, or a combination thereof, wherein at least one of the oil or the wax comprises a very long chain fatty acid; and wherein at least one of the oil or the wax has been modified to increase a concentration of the very long chain fatty acid relative to a reference concentration of the very long chain fatty acid in the oil or the wax without the modification. The method of modification can include, for example, transgenic or conventional oilseed crop breeding routes.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described aspects are usable in all aspects of the disclosure taught herein. Furthermore, the individual features of the dependent claims, as well as all optional and preferred features and modifications of the described aspects are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

(FIG. 2A), 100° C. (FIG. 2B), 150° C. (FIG. 2C), and 200° C. (FIG. 2D).

(FIG. 3A), 100° C. (FIG. 3B), 150° C. (FIG. 3C), and 200° C. (FIG. 3D).

FIGS. 5A-5C show a comparison of the mol % composition of fatty acids (FIG. 5A), the dynamic viscosity (FIG. 5B), and the oxidation induction time values (FIG. 5C) between pennycress-LE oil and pennycress oil.

FIGS. 7A-7B show representative optical micrograph analyses for pennycress-LE oil and pennycress oil at various temperatures both in air at 10 N (FIG. 7C) and in a nitrogen atmosphere at 10 N (FIG. 7D).

Figures 1A, 1B:
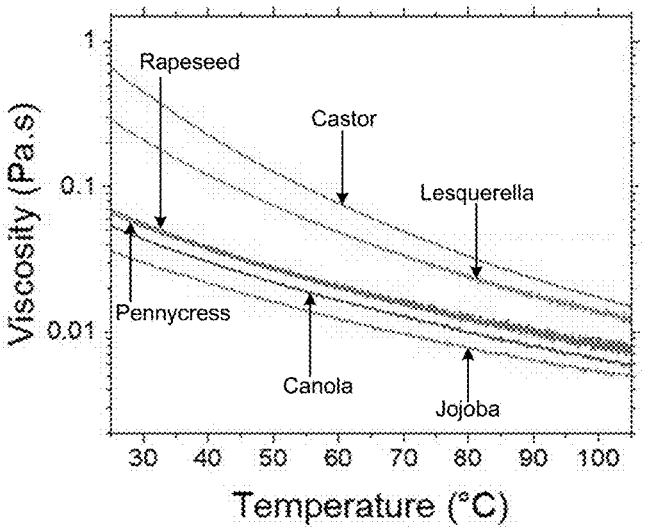
FIG. 1A shows a representative dynamic viscosity analysis of bio-oil samples.
FIG. 1B shows representative results from an oxidation induction time analysis performed at 120° C. for 2 hours.

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION

This disclosure is not limited to particular embodiments described, and as such may, of course, vary. The terminology used herein serves the purpose of describing particular embodiments only, and is not intended to be limiting, since the scope of the present disclosure will be limited only by the appended claims.

Where a range of values is provided, each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Embodiments of the present disclosure will employ, unless otherwise indicated, techniques of medicine, organic chemistry, biochemistry, molecular biology, pharmacology, and the like, which are within the skill of the art. Such techniques are explained fully in the literature.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1 percent to about 5 percent" should be interpreted to include not only the explicitly recited concentration of about 0.1 weight percent to about 5 weight percent but also include individual concentrations (e.g., 1 percent, 2 percent, 3 percent, and 4 percent) and the sub-ranges (e.g., 0.5 percent, 1.1 percent, 2.2 percent, 3.3 percent, and 4.4 percent) within the indicated range. The term "about" can include traditional rounding according to significant figures of the numerical value. In addition, the phrase "about 'x' to 'y'" includes "about 'x' to about 'y'".

Before the embodiments of the present disclosure are described in detail, it is to be understood that, unless otherwise indicated, the present disclosure is not limited to particular materials, reagents, reaction materials, manufacturing processes, dimensions, frequency ranges, applications, or the like, as such can vary. It is also to be understood that the terminology used herein is for purposes of describing particular embodiments only, and is not intended to be limiting. It is also possible in the present disclosure that steps can be executed in different sequence, where this is logically possible. It is also possible that the embodiments of the present disclosure can be applied to additional embodiments involving measurements beyond the examples described herein, which are not intended to be limiting. It is furthermore possible that the embodiments of the present disclosure can be combined or integrated with other measurement techniques beyond the examples described herein, which are not intended to be limiting.

It should be noted that, as used in the specification and the appended claims, the singular forms "a," "an," and "the" include plural referents unless the context clearly dictates otherwise. Thus, for example, reference to "a fatty acid", "an oil", or "a wax" includes a plurality of fatty acids, oils, or waxes, respectively. In this specification and in the claims that follow, reference will be made to a number of terms that shall be defined to have the following meanings unless a contrary intention is apparent.

Reference throughout this specification to "one aspect", "an aspect", "another aspect", "some aspect," means that a particular feature, structure or characteristic described in connection with the aspect is included in at least one embodiment or aspect of the present invention. Thus, appearances of the phrases "in one aspect," "in an aspect," "in another aspect", or "in some aspect" in various places throughout this specification are not necessarily all referring to the same embodiment or aspect, but may. Furthermore, the particular features, structures or characteristics may be combined in any suitable manner, as would be apparent to a person skilled in the art from this disclosure, in one or more embodiments. Furthermore, while some aspects described herein include some but not other features included in other aspects, combinations of features of different aspects are meant to be within the scope of the invention. For example, in the appended claims, any of the claimed aspects can be used in any combination.

Each of the applications and patents cited in this text, as well as each document or reference cited in each of the applications and patents (including during the prosecution of each issued patent; "application cited documents"), and each of the PCT and foreign applications or patents corresponding to and/or claiming priority from any of these applications and patents, and each of the documents cited or referenced in each of the application cited documents, are hereby expressly incorporated herein by reference. Further, documents or references cited in this text, in a Reference List before the claims, or in the text itself; and each of these documents or references ("herein cited references"), as well as each document or reference cited in each of the herein-cited references (including any manufacturer's specifications, instructions, etc.) are hereby expressly incorporated herein by reference.

Prior to describing the various embodiments, the following definitions are provided and should be used unless otherwise indicated.

A. Definitions

Unless defined otherwise, all technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

The term "fatty acid," as used herein, refers to a saturated or unsaturated monocarboxylic acid having an aliphatic tail, which may include from about 4 to about 32 carbon atoms. The fatty acid may be a saturated monocarboxylic acid having the general formula $C_nH_{2n+1}COOH$, wherein n is a positive integer. In one example, n may be from about 4 to about 28. The aliphatic tail of the fatty acid may have on or more hydroxyl functional groups, or the tail of the fatty acid may be free of hydroxyl functional groups. The fatty acid may occur naturally in the form of esters in fats, waxes, and essential oils or in the form of glycerides in fats and fatty oils. Examples of fatty acids can include, but are not limited to, oleic acid, myristic acid, palmitic acid, rumenic acid, vaccenic acid, myrisoleic acid, palmitoleic acid, stearic acid, and alpha-linoleic acid. It may also include any other conventional fatty acids, derivatives thereof, and combinations thereof. For ease of description, fatty acids will in some aspects be described using the nomenclature "CX:Y—$(OH)_Z$" where X is the number of carbon atoms in the chain, Y is the number of double bonds in the chain, and Z is the number of hydroxyl groups. If there are no hydroxyl groups, the nomenclature is simply "CX:Y". For example, a fatty acid having 24 carbon atoms, 1 double bond, and 2 hydroxyl groups can be denoted by "C24:1-$(OH)_2$".

The terms "triacylglycerol" and "triacylglyceride", as interchangeably used herein, refer to tri esters of three fatty acids (or estolides thereof) and glycerol. For ease of description, triacylglycerols will in some aspects be described by the structure of each of the fatty acids from which it is derived using the nomenclature [CX:Y—$(OH)_Z$]—[CX:Y—$(OH)_Z$]—[CX:Y—$(OH)_Z$] where each occurrence "CX:Y—$(OH)_Z$" describes the structure of one of the three fatty acids in the triacylglyceride and can be the same or different. For example, [C18:2]-[C18:2]-[C24:1-$(OH)_2$] describes the tri ester of glycerol with three fatty acids with (i) two of them having 18 carbon atoms and 2 double bonds and (ii) the third having 24 carbon atoms, 1 double bond, and 2 hydroxyl groups.

The term "petroleum oil," as used herein, refers to oils produced entirely or primarily from fossil material, such as petroleum, natural gas, coal, etc.

The term "synthetic oil," as used herein, refers to products produced by reacting carboxylic acids with glycerol, e.g., glycerol triacetate, and the like. It will be understood that such synthetic oils can contain between about 0.1 wt % to about 20 wt. % mono- and di-glycerides, and mixtures thereof.

The term "semisolid," as used herein, refers to compositions that at or around room temperature (a temperature of about 15° C. to 25° C. or about 20° C. to 25° C.) are not free flowing in the same way as a liquid and may have a consistency of a paste, cream, or a grease.

B. Abbreviations

COF coefficient of friction
FA fatty acid
FTIR Fourier transformation infrared spectroscopy
OIT oxidation induction time
Pennycress-LE pennycress fatty acid elongase1 (fae1) mutant
TAG triacylglycerol
VLC FA very long chain fatty acid
WE wax ester

C. Discussion

The present disclosure provides for lubricant compositions and methods of making lubricant compositions containing at least one oil or wax that has been modified to increase the very long chain fatty acid (VLC FA) content. In one aspect, the lubricant compositions can include an oil or wax high in a VLC FA (e.g., erucic acid, eicosenoic acid, nervonic acid), triacylglycerols thereof, esters thereof, and mixtures thereof. Oils with increased erucic acid content can have improved oxidation stability, lubrication, and viscosity compared to oils with lower erucic acid content.

A lubricant composition can be considered high in a particular component, such as a fatty acid, when the component is present in an amount of about 30% to about 80% by weight based on the total weight of the composition. In another aspect a lubricant composition can be considered high in a particular component when the component is present in an amount of about 30% to about 80%, about 30% to about 70%, about 40% to about 60%, about 50% to about 80%, about 50% to about 70%, or about 70% to about 80% by weight based on a total weight of the composition. As used herein, a lubricant composition is said to be low in a particular component when the component is present in an amount of about 0.1% to about 15% by weight based on a total weight of the composition. In another aspect, a lubricant composition can be considered low in a particular component when said component is present in an amount of about 0.1% to 5%, about 5% to 15%, about 5% to 10%, or about 10% to 15% by weight based on a total weight of the composition. In one aspect, the lubricant compositions disclosed herein can contain at least one oil or wax extracted from rapeseed, pennycress seed, canola, jojoba, palm, and mustard. In another aspect, the lubricant compositions disclosed herein can include at least one oil or wax extracted from a plant of the Brassicaceae family. In one aspect, the lubricant compositions can include unmodified oils in addition to modified oils.

The lubricant compositions can be in a liquid form or semisolid form, and can include oil/oil mixtures, oil/wax mixtures, or wax/wax mixtures. In one aspect, the lubricant compositions can include one or more additives. Additives can be oil additives and/or grease additives. At room temperature (about 15° C. to 25° C. or about 20° C. to 25° C.) an oil additive will typically be in a liquid form and a grease additive will typically be in a solid or semisolid form. In another aspect, an oil additive can be turned into a grease additive by adding (e.g., emulsifying) the oil additive with a thickener. Suitable thickeners can include a soap such as calcium stearate, sodium stearate, lithium stearate, lithium 12-hydroxystearate, or a combination thereof. The oil additives and/or grease additives can include antioxidants, antiwear additives, corrosion inhibitors, detergents, metal deactivators, viscosity modifiers, dispersants, or a combination thereof.

In one aspect, the additives are antioxidants such as (+)-α-tocopherol (TCP), propyl gallate (PG), I-ascorbic acid 6-palmitate (AP), 4,4'-methylenebis (2,6-di-tert-butylphenol) (MBP), butylated hydroxyl anisole (BHA), butylated hydroxyl toluene (BHT), propyl gallate (PG), tert-butyl hydroquinone (TBHQ), or a combination thereof. In another aspect, the additive is an antiwear additive such as zinc dithiophosphate (ZDP), zinc dialkyl dithio phosphate (ZDDP), tricresyl phosphate (TCP), dioleyl phosphite, bis (2-ethyl hexyl) phosphate, diphenyl cresyl phosphate, triphenyl phosphorothionate, chlorinated paraffins, glycerol mono oleate, or a combination thereof. The additives can include a corrosion inhibitor such as a thiadiazole, a benzotriazole, a tolutriazole, a zinc dithiophosphate, a metal phenolate, a metal sulfonate, a fatty acid, a carboxylic acid, an amine, or a combination thereof. The additive can include a detergent such as a polyisobutylene succinimide, a polyisobutylene amine succinimide, an aliphatic amine, a polyolefin maleic anhydride, or a combination thereof. Metal deactivators such as a triazole, a tolyltriazole, a thiadiazole, or a combination thereof can also be included as additives. In one aspect, the additives can include viscosity modifiers such as an ethylene-olefin co-polymer, a maleic anhydride-styrene alternating copolymer, a polymethacrylate, a hydrogenated styrene-butadiene copolymer, a hydrogenated styrene-isoprene copolymer, an ester thereof, or a combination thereof. The additives can also include dispersants such as succinimide or benzylamine. The additives can include any combination of the different types of additives.

The lubricant compositions can include additive compositions for lubricating oils including a liquid lubricant composition described herein. In one aspect, a lubricant composition can be provided having a petroleum or a synthetic base oil and about 10% to about 40% by weight of a liquid lubricant composition described herein.

In one aspect, semisolid lubricants are provided wherein an oil is emulsified with a thickener. In one aspect, suitable thickeners can include a soap such as calcium stearate, sodium stearate, lithium stearate, lithium 12-hydroxystearate, or a combination thereof. In another aspect, a suitable thickener can include nanoclay. Nanoclays are nanoparticles comprised of layers of silicates (e.g., aluminosilicate). In one aspect, particle size of nanoclays range from about 10 nm to about 100 nm. In one aspect, the layers of silicates can have a thickness ranging from about 0.5 nm to about 5 nm. In one aspect, semisolid lubricants as disclosed herein that comprise a nanoclay as the thickener in place of a soap such as a lithium soap can be considered biosafe. In a further aspect, the lubricant composition can comprise from about 1 wt % to about 25 wt %, about 1 wt % to about 20 wt %, about 1 wt % to about 15 wt %, about 1 wt % to about 10 wt %, about 1 wt % to about 8 wt %, about 1 wt % to about 6 wt %, about 3 wt % to about 20 wt %, about 3 wt % to about 15 wt %, about 3 wt % to about 10 wt %, about 3 wt % to about 8 wt %, about 10 wt % to about 20 wt %, or about 4 wt % to about 6 wt % nanoclay.

The present disclosure also provides for methods of making lubricant compositions. The methods can include extracting oil from the seeds of a plant. The extractions can include pressing, heat, and/or solvent extractions. The methods can further include esterification of the oil with one or more fatty acids. The methods can also include mixing with one or more additives. If forming a semisolid lubricant, the methods can include forming an emulsion of the oil with a suitable thickener.

In the process of extracting oil from the seeds of a plant, the seed can be cleaned and dried and foreign material can be removed. Crushing can be done using mill, steel rolls, or other suitable means. The seeds can be mechanically pressed in expellers after a preheating step in indirectly heated conditioners. The oil-bearing material can be fed into one end of a cylinder where a power-driven worm or screw conveyor forces the material to the other end of the cylinder and out against resistance. The pressure exerted in the process can extract out the oil. Alternatively, solvent extraction can be used to separate oil from the seeds. The pre-processed seeds can be treated in a multistage counter current process with solvent until the remaining oil content is reduced. The mixture of oil and solvent can be separated by distillation and the solvent can be recycled into the extraction process.

In one aspect, the method of making lubricant compositions can also include modifying a base oil to increase the concentration of a VLC FA, such as erucic acid, eicosenoic acid, and/or nervonic acid, relative to the reference concentration of VLC FA in the unmodified, base oil. These methods can include transgenic routes, such as those discussed in Wang et al. (Wang, P. et al. "A Review of Erucic Acid Production in Brassicaceae Oilseeds: Progress and Prospects for the Genetic Engineering of High and Low-Erucic Acid Rapeseeds (*Brassica napus*)". Frontiers in Plant Science, 13, p. 899076.) and Li et al. (Li, X. et al. "Development of Ultra-High Erucic Acid Oil in the Industrial Oil Crop *Crambe abyssinica*". Plant biotechnology journal, 10 (7), pp. 862-870.), which are incorporated herein by reference. For example, it was shown in Li. Et al. that ectopic expression of LdLPAAT and BnFAE1 in *Crambe abyssinica* plants along with knock down of FAD2 function increased seed oil erucic acid content from 60% in the wild type to 73% in the best transgenic line.

In another aspect, the method of making lubricant compositions can include introducing into an oilseed plant cell a nuclease and a guide sequence, where the guide sequence includes a nucleic acid sequence(s) specific to a fatty acid biosynthetic gene, a triacylglyceride biosynthetic gene, and/or related regulatory genes or sequences, such as FATTY ACID ELONGATION1 (FAE1), FATTY ACID DESATURASE2 (FAD2), and/or REDUCED OLEATE DESATURATION1 (ROD1). The method also can include selecting an oilseed plant cell containing a genetic change(s) that gives rise to a plant producing oil having altered lubricant compositions as compared to a wild oilseed plant. The oilseed plant can be a pennycress plant. The nuclease can be a clustered regularly interspaced short palindromic repeats (CRISPR) associated system (Cas) nuclease. The Cas nuclease can be a Cas9 nuclease. The Cas9 nuclease can be a *Streptococcus pyogenes* Cas9 (SpCas9). The method(s) can be that as described in McGinn et al. (McGinn, M. et al., 2019. "Molecular tools enabling pennycress (*Thlaspi arvense*) as a model plant and oilseed cash cover crop". *Plant biotechnology journal,* 17 (4), pp. 776-788.), Jarvis et al. (Jarvis, B. A., et al., 2021. "CRISPR/Cas9-induced fad2 and rod1 mutations stacked with fae1 confer high oleic acid seed oil in pennycress (*Thlaspi arvense* L.)". *Frontiers in plant science,* 12, p. 652319.), Zhu et al. (Zhu, H., et al., 2020. "Applications of CRISPR-Cas in agriculture and plant biotechnology. *Nature Reviews Molecular Cell Biology",* 21 (11), pp. 661-677.), and Nidhi et al. (Nidhi, S. et al., 2021. "Novel CRISPR-Cas systems: an updated review of the current achievements, applications, and future research perspectives". *International journal of molecular sciences,* 22 (7), p. 3327.).

In another aspect, the method of making lubricant compositions can also include introducing into an oilseed plant cell a mutagen that alters genetic sequence(s) encoding fatty acid biosynthetic gene(s), triacylglyceride biosynthetic gene(s), and/or related regulatory gene(s). The method can include modifying one or more genes or regulatory sequences of genes in the oilseed plant genome, where the gene encodes a polypeptide and/or a microRNA involved in lubricant composition. The mutagen can include ethyl methane sulphonate (EMS). The method also can include selecting an oilseed plant cell having altered lubricant compositions as compared to a wild oilseed plant; and regenerating an oilseed plant having altered lubricant compositions from the selected oilseed plant cell. The method can be that as described in Chopra et al. (Chopra, R. et al., 2018. "Translational genomics using *Arabidopsis* as a model enables the characterization of pennycress genes through forward and reverse genetics". *The Plant Journal,* 96 (6), pp. 1093-1105.).

The lubricant compositions can be used in a variety of applications, for example in engines or in other industrial applications. The lubricant compositions can replace many uses of petroleum-based lubricants and/or many uses of castor-oil based lubricants. Any number of applications will be readily ascertained upon reading the present disclosure when accompanied with the below examples.

While embodiments of the present disclosure are described in connection with the Examples and the corresponding text and figures, there is no intent to limit the disclosure to the embodiments in these descriptions. On the contrary, the intent is to cover all alternatives, modifications, and equivalents included within the spirit and scope of embodiments of the present disclosure.

D. Aspects

The following listing of exemplary aspects supports and is supported by the disclosure provided herein.

Aspect 1. A lubricant composition, comprising an oil, a wax, or a combination thereof, wherein at least one of the oil or the wax comprises a very long chain fatty acid (VLC FA); and wherein at least one of the oil or the wax has been modified to increase a concentration of the VLC FA relative to a reference concentration of the VLC FA in the oil or the wax without the modification.

Aspect 2. The lubricant composition of aspect 1, wherein the oil or the wax has been modified via a transgenic route, a breeding route, or a combination thereof.

Aspect 3. The lubricant composition of aspect 2 or aspect 3, wherein the VLC FA comprises about 30% to about 80% by weight of a total weight of the oil or the wax.

Aspect 4. The lubricant composition of aspect 2 or aspect 3, wherein the VLC FA comprises about 50% to about 80% by weight of a total weight of the oil or the wax.

Aspect 5. The lubricant composition of any one of aspects 1-4, wherein the VLC FA is one or more of eicosenoic acid, erucic acid, or nervonic acid.

Aspect 6. The lubricant composition of any one of aspects 1-5, wherein the VLC FA is erucic acid.

Aspect 7. The lubricant composition of any one of aspects 1-6, further comprising a thickener.

Aspect 8. The lubricant composition of aspect 7, wherein the thickener is a soap selected from the group consisting of calcium stearate, sodium stearate, lithium stearate, lithium 12-hydroxystearate, and a combination thereof.

Aspect 9. The lubricant composition of aspect 7, wherein the thickener is a nanoclay.

Aspect 10. The lubricant composition of aspect 9, wherein the nanoclay is from about 1 wt % to about 20 wt % of the total lubricant composition.

Aspect 11. The lubricant composition of any one of aspects 1-10, wherein the lubricant composition is in the form of a semisolid lubricant composition at room temperature.

Aspect 12. The lubricant composition of any one of aspects 1-11, further comprising one or more grease additives.

Aspect 13. The lubricant composition of aspect 12, wherein the one or more grease additives are selected from the group consisting of an antioxidant, an antiwear additive, a corrosion inhibitor, a detergent, a metal deactivator, a viscosity modifier, a dispersant, and a combination thereof.

Aspect 14. The lubricant composition of aspect 13, wherein the antioxidant is selected from the group consisting of (+)-α-tocopherol, propyl gallate, l-ascorbic acid 6-palmitate, 4,4'-methylenebis (2,6-di-tert-butylphenol), butylated hydroxyl anisole, butylated hydroxyl toluene, propyl gallate, tert-butyl hydroquinone, and a combination thereof.

Aspect 15. The lubricant composition of aspect 13 or aspect 14, wherein the antiwear additive is selected from the group consisting of zinc dithiophosphate, zinc dialkyl dithiophosphate, tricresyl phosphate, dioleoyl phosphite, bis(2-ethylhexyl) phosphate, diphenyl cresyl phosphate, triphenyl phosphorothionate, chlorinated paraffins, glycerol monooleate, and a combination thereof.

Aspect 16. The lubricant composition of any one of aspects 13-15, wherein the corrosion inhibitor is selected from the group consisting of a thiadiazole, a benzotriazole, a tolutriazole, a zinc dithiophosphate, a metal phenolate, a metal sulfonate, a fatty acid, a carboxylic acid, an amine, and a combination thereof.

Aspect 17. The lubricant composition of any one of aspects 13-16, wherein the detergent is selected from the group consisting of a polyisobutylene succinimide, a polyisobutylene amine succinimide, an aliphatic amine, a polyolefin maleic anhydrides, and a combination thereof.

Aspect 18. The lubricant composition of any one of aspects 13-17, wherein the metal deactivator is selected from the group consisting of a triazole, a tolyltriazole, a thiadiazole, and a combination thereof.

Aspect 19. The lubricant composition of any one of aspects 13-18, wherein the viscosity modifier is selected from the group consisting of an ethylene-olefin co-polymer, a maleic anhydride-styrene alternating copolymer, a polymethacrylate, a hydrogenated styrene-butadiene copolymer, a hydrogenated styrene-isoprene copolymer, an ester thereof, and a combination thereof.

Aspect 20. The lubricant composition of any one of aspects 13-19, wherein the dispersant is selected from the group consisting of succinimide, benzylamine, and a combination thereof.

Aspect 21. The lubricant composition of any one of aspects 1-10, wherein the lubricant composition is in the form of a liquid at standard temperature and pressure.

Aspect 22. The lubricant composition of aspect 21, further comprising one or more oil additives.

Aspect 23. The lubricant composition of aspect 22, wherein the one or more oil additives are selected from the group consisting of an antioxidant, an antiwear additive, a corrosion inhibitor, a detergent, a metal deactivator, a viscosity modifier, a dispersant, and a combination thereof.

Aspect 24. The lubricant composition of aspect 23, wherein the antioxidant is selected from the group consisting of (+)-α-tocopherol (TCP), propyl gallate (PG), l-ascorbic acid 6-palmitate (AP), 4,4'-methylenebis (2,6-di-tert-butylphenol) (MBP), butylated hydroxyl anisole (BHA), butylated hydroxyl toluene (BHT), propyl gallate (PG), tert-butyl hydroquinone (TBHQ), and a combination thereof.

Aspect 25. The lubricant composition of aspect 22 or aspect 23, wherein the antiwear additive is selected from the group consisting of zinc dithiophosphate (ZDP), zinc dialkyl dithiophosphate (ZDDP), tricresyl phosphate (TCP), dioleoyl phosphite, bis(2-ethylhexyl) phosphate, diphenyl cresyl phosphate, triphenyl phosphorothionate, chlorinated paraffins, glycerol monooleate, and a combination thereof.

Aspect 26. The lubricant composition of any one of aspects 22-25, wherein the corrosion inhibitor is selected from the group consisting of a thiadiazole, a benzotriazole, a tolutriazole, a zinc dithiophosphate, a metal phenolate, a metal sulfonate, a fatty acid, a carboxylic acid, an amine, and a combination thereof.

Aspect 27. The lubricant composition of any one of aspects 22-26, wherein the detergent is selected from the group consisting of a polyisobutylene succinimide, a polyisobutylene amine succinamide, an aliphatic amine, a polyolefin maleic anhydrides, and a combination thereof.

Aspect 28. The lubricant composition of any one of aspects 22-27, wherein the metal deactivator is selected from the group consisting of a triazole, a tolyltriazole, a thiadiazole, and a combination thereof.

Aspect 29. The lubricant composition of any one of aspects 22-28, wherein the viscosity modifier is selected from the group consisting of an ethylene-olefin co-polymer, a maleic anhydride-styrene alternating copolymer, a polymethacrylate, a hydrogenated styrene-butadiene copolymer, a hydrogenated styrene-isoprene copolymer, an ester thereof, and a combination thereof.

Aspect 30. The lubricant composition of any one of aspects 22-29, wherein the dispersant is selected from the group consisting of succinimide, benzylamine, and a combination thereof.

Aspect 31. The lubricant composition of any one of aspects 1-30, wherein the oil or the wax is extracted from a plant of the Brassicaceae family.

Aspect 32. The lubricant composition of any one of aspects 1-30, wherein the oil or the wax is extracted from a plant selected from rapeseed, pennycress, canola, jojoba, palm, mustard, and a combination thereof.

Aspect 33. A method for reducing friction in an engine or other mechanical device, comprising disposing the lubricant composition of any one of aspects 1-32 on at least one surface of the engine or other mechanical device.

From the foregoing, it will be seen that aspects herein are well adapted to attain all the ends and objects hereinabove set forth together with other advantages which are obvious and which are inherent to the structure.

While specific elements and steps are discussed in connection to one another, it is understood that any element and/or steps provided herein is contemplated as being combinable with any other elements and/or steps regardless of explicit provision of the same while still being within the scope provided herein.

It will be understood that certain features and subcombinations are of utility and may be employed without reference to other features and subcombinations. This is contemplated by and is within the scope of the claims.

Since many possible aspects may be made without departing from the scope thereof, it is to be understood that all matter herein set forth or shown in the accompanying drawings and detailed description is to be interpreted as illustrative and not in a limiting sense.

It is also to be understood that the terminology used herein is for the purpose of describing particular aspects only and is not intended to be limiting. The skilled artisan will recognize many variants and adaptations of the aspects described herein. These variants and adaptations are intended to be included in the teachings of this disclosure and to be encompassed by the claims herein.

Now having described the aspects of the present disclosure, in general, the following Examples describe some additional aspects of the present disclosure. While aspects of the present disclosure are described in connection with the following examples and the corresponding text and figures, there is no intent to limit aspects of the present disclosure to this description. On the contrary, the intent is to cover all alternatives, modifications, and equivalents included within the spirit and scope of the present disclosure.

E. Examples

Introduction. In many industrial applications, energy is lost because of friction. Approximately 28% of fuel energy in passenger cars is lost overcoming friction in engine, transmission, and drive train parts [1] signifying the need for more environmentally friendly and energy-efficient solutions [2-4]. Lubrication is used to enhance the performance and efficiency of two parts in motion by creating a thin film between them and reducing the heat generated by friction [5], and is one of the solutions used in energy conservation. Petroleum-based lubricants, used as is or with additives, form a major proportion of lubricants used in many applications due to their chemical and physical properties [6-7], but their toxicity poses a threat to the environment, and they are non-renewable. In some industries where the machinery is close to a water body such as agriculture and offshore drilling, the use of petroleum-based lubricants contaminates the ecosystem due to engine leaks and improper disposal [5].

Environmentally friendly and renewable lubricants have been deemed integral to attaining global sustainability goals, which is driving research into the development and use of vegetable oils for tribological applications. Vegetable oils and their additives, also called bio-lubricants, have been used as an alternative to petroleum oils to address environmental concerns. Roughly 20-30% of vegetable-based materials degrade faster than mineral-based materials [8-9]. Vegetable oil molecules consist of several polar groups that enable them to create an adsorption film on the surface of metals and ceramics. This film acts as a lubricant and helps in reducing friction [10-13]. The effectiveness of vegetable oils as boundary lubricants is due to their high polarity, which enables them to strongly interact with the surfaces they lubricate.

The chemical composition of most bio-lubricants consists of fatty acid (FA) esters which form a thin film on the point of contact between two objects. This helps reduce wear oxidation. The performance of boundary lubrication is influenced by both the attraction of the lubricant molecules to the surface and any potential reactions with the surface [14]. Moreover, bio-lubricants are derived from renewable sources and are environmentally friendly as they are biodegradable and have low toxicity towards the ecosystem and humans [15]. According to earlier studies [16-19], vegetable oils exhibit superior performance compared to mineral base oils in various aspects, including antiwear and friction, scuffing load capacity, and fatigue resistance. Notably, these advantages were observed even without the use of any additives [20-21]. Jojoba oil is the lubricant that is used in the cosmetic industry [22]. Jojoba oil consists of highly stable liquid wax esters that contain primarily mono-unsaturated very long chain (VLC) FAs and fatty alcohols (FOH) that lend to both the thermal and oxidative stability of this oil and ultimately its value as a bio lubricant [13-14]. Other examples of plant-based oils of interest with VLC FAs include rapeseed oil, used for enhancing the tribological performance of lubricants when introduced as an additive, and recently pennycress oil which is being developed as a feedstock for biodiesel, renewable diesel, and sustainable aviation fuels [25-26]. Rapeseed and pennycress seed oils, like essentially all other vegetable oils, contain primarily triacylglycerols which are comprised of three FAs esterified to a glycerol backbone, rather than jojoba seed wax esters which are comprised of FAs esterified to FOHs. Interestingly, the dominant VLC FA in rapeseed and pennycress seed oils is C22: 1 or erucic acid, which is also a dominant VLC FA found in the wax esters of jojoba oil (WE 40:2; WE 42:2; WE 44:2). Therefore, the chemical natures of rapeseed, pennycress, jojoba oils share both similarities and differences in their principal oil constituents.

Castor oil, which has been highly investigated by different industries, also is an excellent bio-lubricant because of its high viscosity and the predominance of the hydroxylated FA, ricinoleic acid (C18:1-OH), which plays a major role in castor oil lubricity [27]. Additionally, *lesquerella* seed oil, also with hydroxylated FA (C20:1-OH), showed promising results for wear resistivity and oxidation resistivity besides castor, pennycress, and other oils [28].

Experimental Procedures. Oil samples: For the study, seven different oils available commercially were selected. Among them were wild-type pennycress having high erucic acid content in its seeds similar to rapeseed, fatty acid elongase1 (fae1) mutant pennycress having low erucic acid and low eicosenoic acid (C20:1 cis) content (LE) similar to canola, rapeseed, canola, castor, *lesquerella*, and jojoba. The performance of all the oils was compared to the performance of PAO4 and PAO10, synthetic oils widely used in industrial applications. Elaborated analyses were performed on the pennycress oils by looking at the effects altering FA composition had on the oil stability and performance upon exposure to higher temperatures.

Tribological Analyses:

The tribological tests were performed using a TRB$^3$ Pin-On-Disk tribometer (Anton Paar) with a controlled environment (dry nitrogen) and heating stage (temperature variation from room temperature up to 400° C.) capabilities. The samples used for the tribological studies were AISI 52100 steel balls with 6 mm diameter and AISI 52100 steel flats with 25.4 mm (1 inch) diameter, both purchased from McMaster Carr. AISI 52100 steel is a common material used in many industrial applications, especially in bearings and gears. All the tests were carried out using a reciprocating movement, which is a standard method for measuring wear and friction properties to provide accurate and reliable results since it simulates real-world conditions. The tests were performed at a frequency of 2 Hz, with a maximum linear speed of 0.88 cm/s, and a stroke length of 1.4 mm. The tests were performed for three normal loads 1N, 10N, and 20N (0.46 GPa, 0.99 GPa, and 1.25 GPa) in air and in a nitrogen atmosphere at four different temperatures, 25° C., 100° C., 150° C., and 200° C., to analyze the effectiveness of bio-lubricants friction and wear reduction. The selected temperature range of 25-200° C. and normal loads 1-20N for the tests are appropriate for evaluating lubricants in a variety of applications as it covers a wide range of operating conditions. For this, the steel surfaces were covered with oils to enable the lubrication of the sliding contact. After the tests, the samples were rinsed with acetone followed by ethanol to eliminate any excess of the oil for further analysis. Each test has been repeated at least four times. As the plant-based lubricants are aimed at substituting synthetic oils in diverse applications, including the food, marine, and automotive industries, the test conditions are representative of the operating conditions that exist in these industries.

Characterization: The chemical composition of the oils was analyzed using either gas-chromatography-mass spectrometry (GC-MS) of their derivatized methyl esters [29-30] or direct infusion electrospray ionization mass spectrometry (ESI-MS) analysis of the intact oil molecules without derivatization [31]. GC-MS analysis was accomplished by the UNT BioAnalytical Facility, while the jojoba oils were analyzed by ESI-MS on a Waters Synapt G2-si high-resolution mass spectrometer. Dynamic viscosity analysis was performed using a TA Discovery HR-2 Rheometer. Oxidation stability analysis was performed by monitoring the oxidation induction time (OIT) in the DSC setup upon introducing 500 PSI of oxygen gas. The measurements and analysis of the wear formed on the substrates and the counter bodies during the tribotests were obtained using a Zeiss Primostar 3 optical microscope at 10 and 50 magnifications.

The ball wear rate was calculated using:

$$K = \frac{V}{Fd} \quad \text{(Eq. 1)}$$

K is the specific wear rate, V is the ball wear volume, F is the normal load, and d is the sliding distance.

V was calculated using:

$$V = \left(\frac{\pi h}{6}\right)\left(\frac{3d^2}{4} + h^2\right) \quad \text{(Eq. 2)}$$

h is the height of the counter-body cap, and d is the diameter of the counter-body scar.

h was calculated using:

$$h = r - \sqrt{r^2 - \frac{d^2}{4}} \quad \text{(Eq. 3)}$$

r is the radius of the counter body.

The chemical analysis and elemental mapping of the wear tracks were performed using Hitachi tabletop microscope TM3030Plus equipped with energy-dispersive X-ray spectroscopy (EDS). The chemical analysis was obtained using a Nicolet 6700 FTIR at 1000-4000 cm-1 spectral range for each of the oil samples treated at 200° C. For each FTIR spectrum, the baseline was collected for the corresponding oil at 25° C.

Figures 5B, 5C:
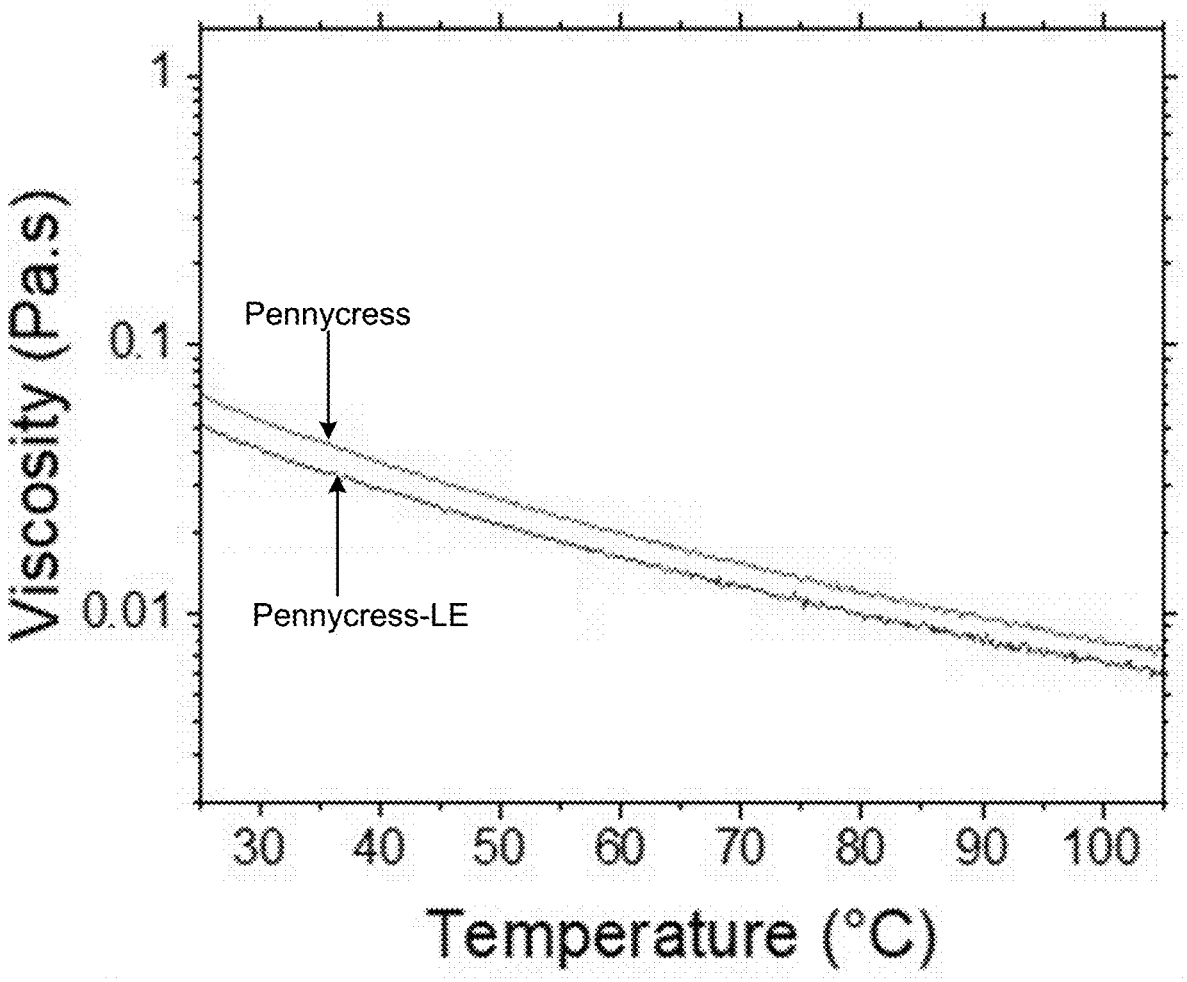

Results and Discussion. Prior to testing, all the oils were analyzed for their chemical composition. Table 1, Table 2, and FIG. 5A summarize the results.

TABLE 1

Mol % composition of FAs of various oils. Numerical values in the "Fatty Acids" column refer to the number of carbons in the acyl chains of the FA followed by numbers of double bonds (with an OH if containing a hydroxyl group).

| Fatty Acids | Pennycress | Rapeseed | Canola | Castor | Lesquerella |
|---|---|---|---|---|---|
| | Mol % Composition | | | | |
| C16:0 | 2.5 | 3.3 | 4.5 | 1.3 | 1.6 |
| C16:1 | 0.1 | 0.2 | 0.2 | 0 | 1 |
| C18:0 | 0.6 | 1 | 2.9 | 1.5 | 2.2 |
| C18:1 cis | 15.5 | 12 | 56.5 | 3.2 | 12.9 |
| C18:1 trans | 1.2 | 0.7 | 2.7 | 0.5 | 2 |
| C18:2 | 18.7 | 11.9 | 18.0 | 4.6 | 7.1 |
| C18:3 | 9.6 | 8.2 | 9.8 | 0.5 | 10.7 |
| C20:0 | 0.3 | 0.9 | 1.0 | 0 | 0.2 |
| C20:1 cis | 9.7 | 7.6 | 2.4 | 0.4 | 1 |
| C20:1 trans | 0.7 | 1.6 | 0.0 | 0 | 0 |
| C20:2 | 1.5 | 0.6 | 0.0 | — | — |
| C22:0 | 0.2 | 0.8 | 0.4 | — | — |
| C22:1 | 35.7 | 49.5 | 1.6 | — | — |
| C22:2 | 0.6 | 0.8 | 0.0 | — | — |
| C24:1 | 3.0 | 1.1 | 0.0 | — | — |
| C18:1-OH | — | — | — | 87.9 | 0.8 |
| C20:1-OH | — | — | — | 0 | 56.4 |
| C20:2-OH | — | — | — | 0 | 4.2 |

TABLE 2

Mol % composition of molecular species of jojoba oil, where the intact WE species or the minor TAG species are annotated with the total number of acyl carbons and the total number of double bonds.

| Molecular Species | Mol % Composition |
|---|---|
| WE-38:1 | 0.32 |
| WE-38:2 | 4.54 |
| WE-40:1 | 2.43 |
| WE-40:2 | 25.63 |
| WE-42:1 | 6.16 |
| WE-42:2 | 44.91 |
| WE-42:3 | 0.29 |
| WE-44:1 | 1.22 |
| WE-44:2 | 12.60 |
| WE-46:2 | 1.13 |
| TAG-54:2 | 0.05 |
| TAG-54:4 | 0.01 |
| TAG-54:7 | 0.00 |
| TAG-54:8 | 0.00 |
| TAG-56:1 | 0.00 |
| TAG-56:2 | 0.12 |
| TAG-56:3 | 0.14 |
| TAG-56:5 | 0.01 |
| TAG-58:2 | 0.08 |
| TAG-58:4 | 0.01 |
| TAG-58:5 | 0.02 |
| TAG-60:2 | 0.05 |
| TAG-60:5 | 0.01 |
| TAG-62:2 | 0.06 |
| TAG-62:3 | 0.22 |
| TAG-64:2 | 0.01 |

FIGS. 1A-1B summarize the viscosity and oxidation stability characteristics of the oils. FIG. 1A shows the dynamic viscosity analysis of six different bio-oils as a function of temperature. The typical trend of viscosity decrease with temperature increase was observed for all the samples. This is attributed to the increase in distance between the molecules that weakens the intermolecular forces and makes the resistance needed for the oil to change shape or movement lower at higher temperatures. Among the six oils, castor oil showed the highest viscosity, and jojoba oil showed the lowest viscosity at all temperatures. Still, the viscosities of all the bio-oil candidates were higher than for the PAO4 (viscosity at 40° C. is 0.018 Pa s), but lower than PAO10 (viscosity at 40° C. is 0.0554 Pa s) baselines, except for castor and *lesquerella* as reported in [32]. Notably, both castor and jojoba oils demonstrated equally good oxidation resistance (>120 minutes at 120° C.) tested with OIT analysis (FIG. 1B). This oxidation resistance is in line with the oxidation resistance of synthetic oils, PAO4 and PAO10. The rest of the oil samples, pennycress, rapeseed, canola, and *lesquerella*, demonstrated much shorter OIT values indicating their relative susceptibility to oxidation at 120° C.

In the next set of experiments, all six bio-oils were tested for their lubrication performance in comparison to PAO4 and PAO10 oils. The conditions of the tests were selected to assess the performance at the boundary lubrication regime (Table 3) with Hersey number calculated as:

$$H = \frac{\eta V}{P} \quad \text{(Eq. 4)}$$

TABLE 3

Hersey's number calculated for all the tests performed at 10N load and temperatures (25° C.-200° C.).

| Lubricant | 25° C. | 100° C. | 150° C. | 200° C. |
|---|---|---|---|---|
| Pennycress | $5.8 \times 10^{-13}$ | $4.9 \times 10^{-14}$ | $4.1 \times 10^{-14}$ | $2.1 \times 10^{-15}$ |
| Rapeseed | $6.2 \times 10^{-13}$ | $7.3 \times 10^{-14}$ | $4.6 \times 10^{-14}$ | $2.5 \times 10^{-15}$ |
| Canola | $4.8 \times 10^{-13}$ | $5.5 \times 10^{-14}$ | $3.9 \times 10^{-14}$ | $2.1 \times 10^{-15}$ |
| Jojoba | $3.3 \times 10^{-13}$ | $4.4 \times 10^{-14}$ | $1.7 \times 10^{-14}$ | $1.3 \times 10^{-15}$ |
| Castor | $5.8 \times 10^{-12}$ | $1.3 \times 10^{-13}$ | $8.7 \times 10^{-14}$ | $8.1 \times 10^{-14}$ |
| Lesquerella | $2.6 \times 10^{-12}$ | $1.3 \times 10^{-13}$ | $1.6 \times 10^{-14}$ | $3.5 \times 10^{-14}$ |
| Pennycress-LE | $4.5 \times 10^{-13}$ | $4.6 \times 10^{-14}$ | $2.9 \times 10^{-14}$ | $1.8 \times 10^{-14}$ |

Figure 2A:
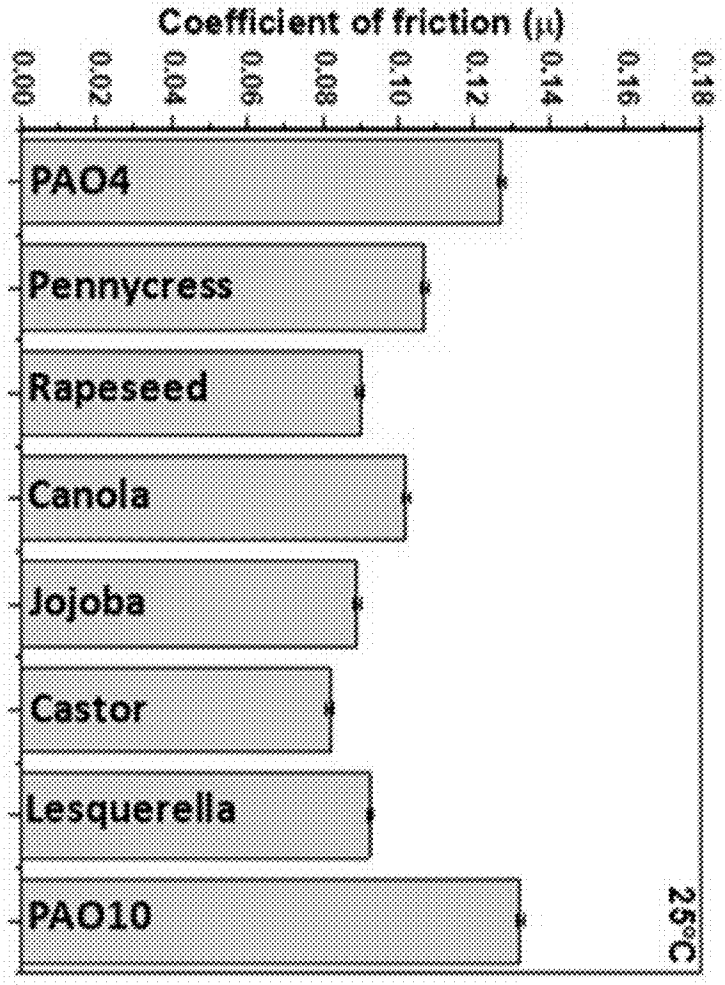
FIGS. 2A-2D show representative coefficient of friction measurements performed at a 10 N load for six bio-lubricants and synthetic oils at 25° C.
Figure 2B:
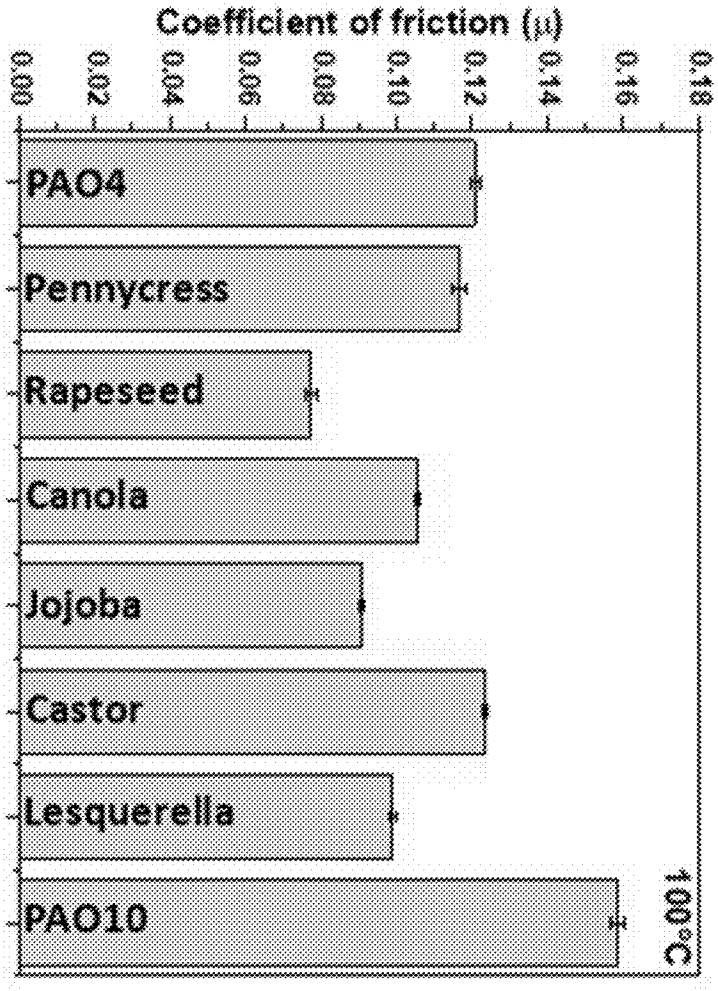
Figure 2C:
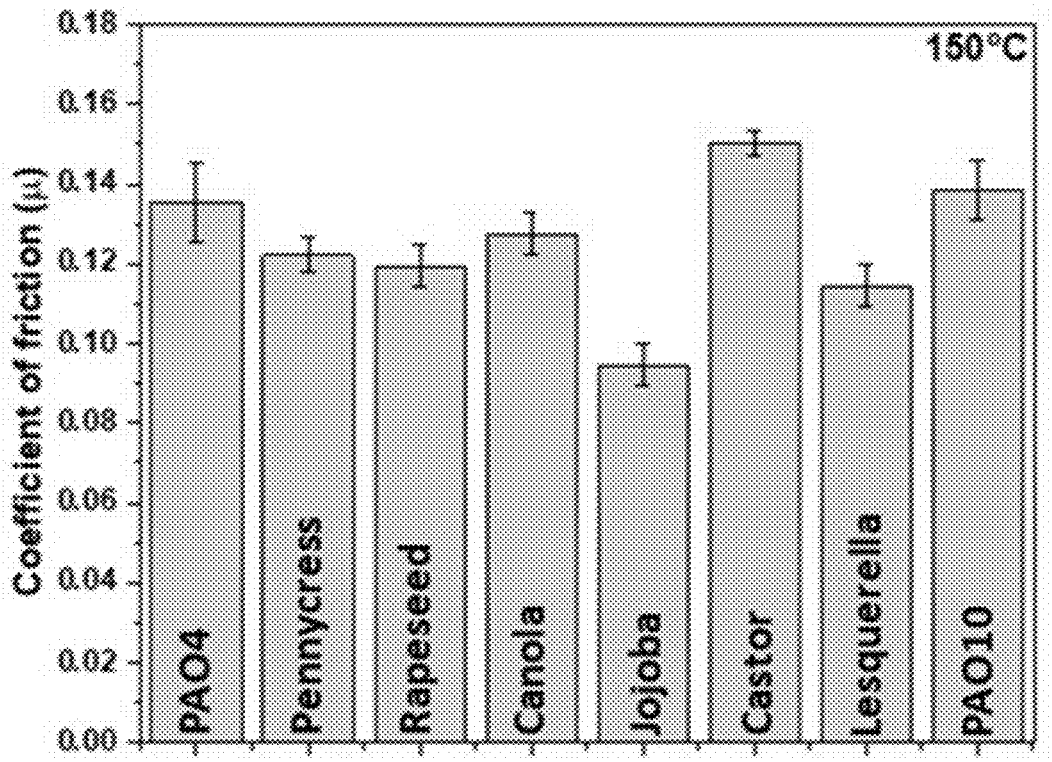
Figure 2D:
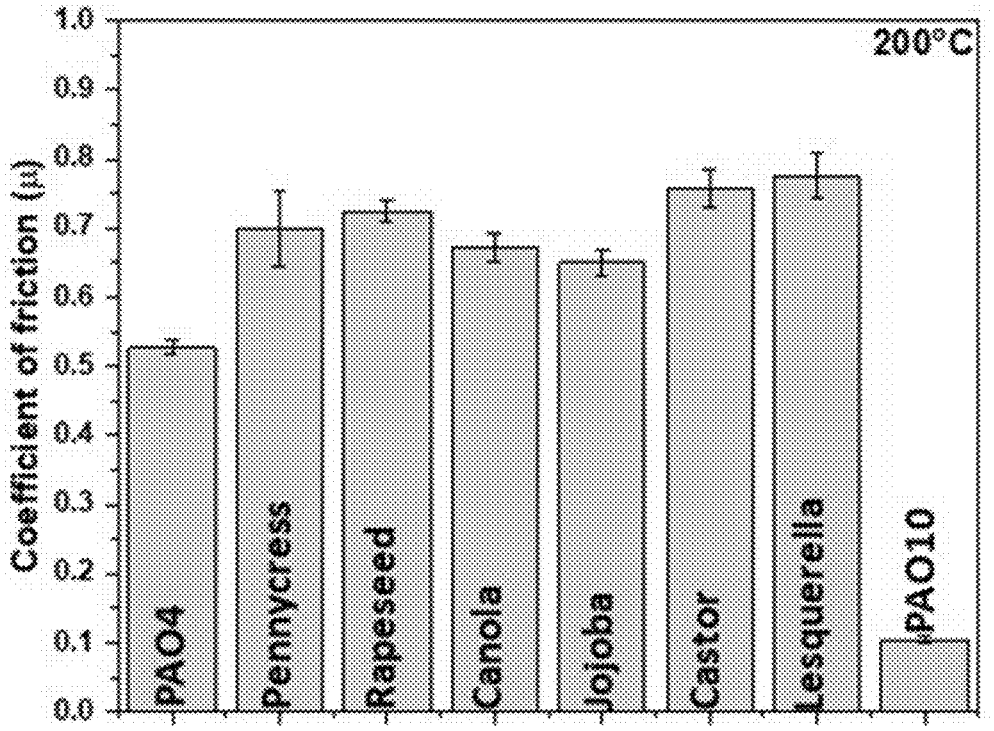
Figure 2E:
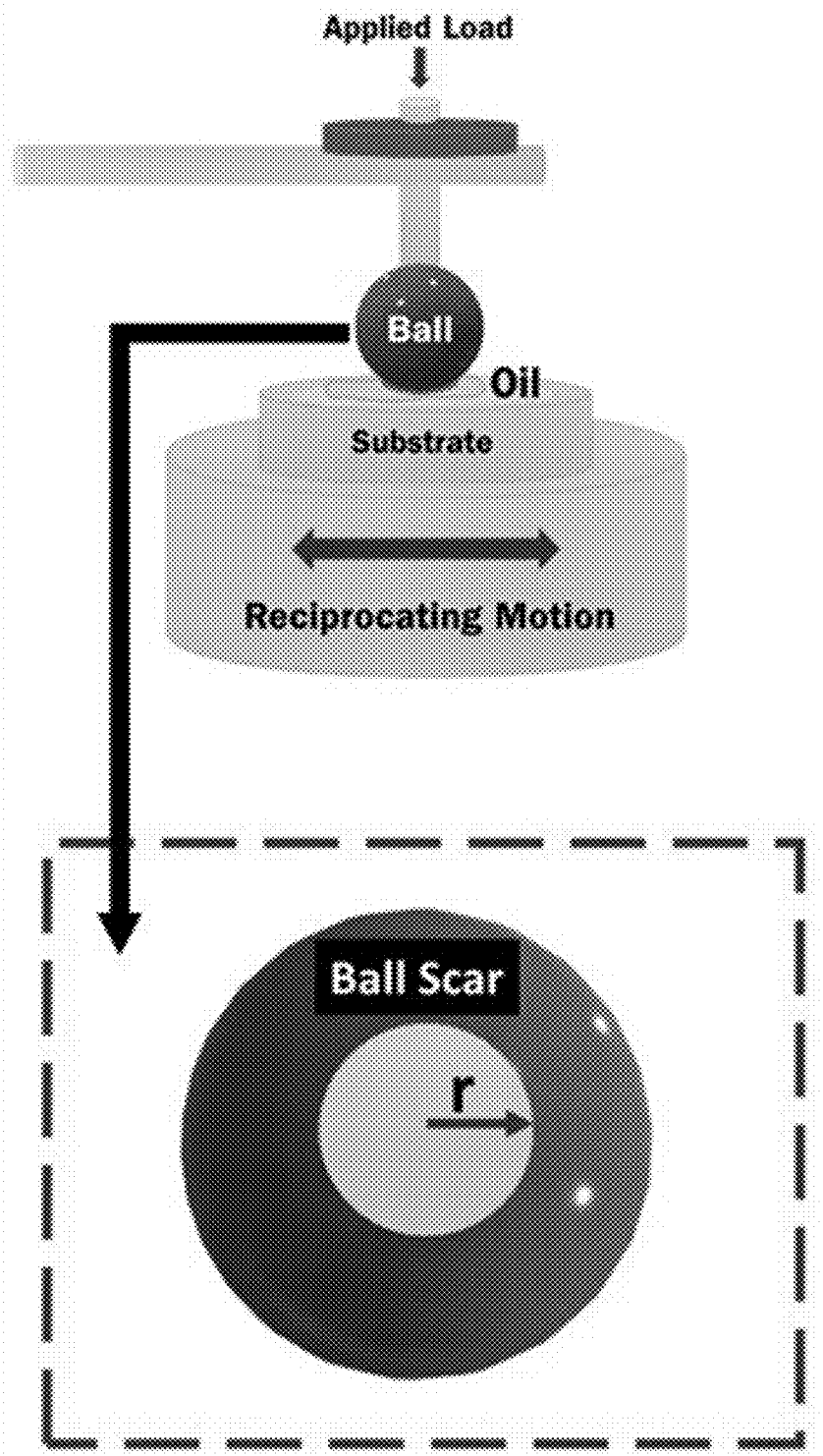
FIG. 2E shows a schematic illustrating tribo-pairs lubricated by oil.
Figure 3A:
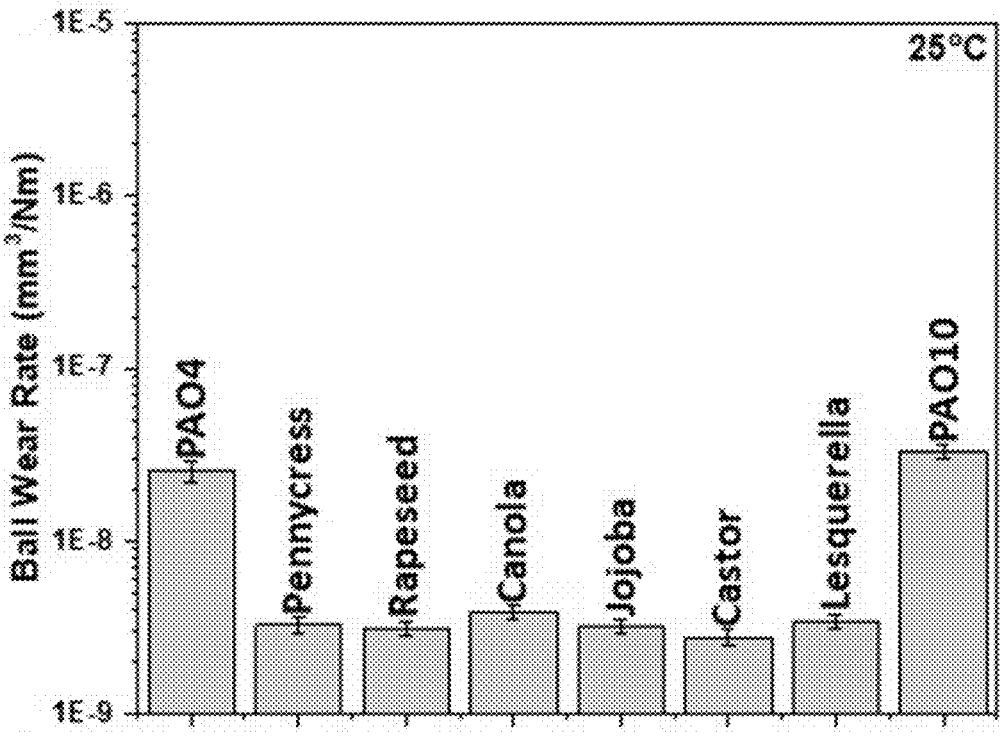
FIGS. 3A-3D show representative ball wear rate measurements at a 10 N load of a 52100 steel surface used in reciprocating tribology tests for six bio-lubricants and synthetic oils at 25° C.
Figure 3B:
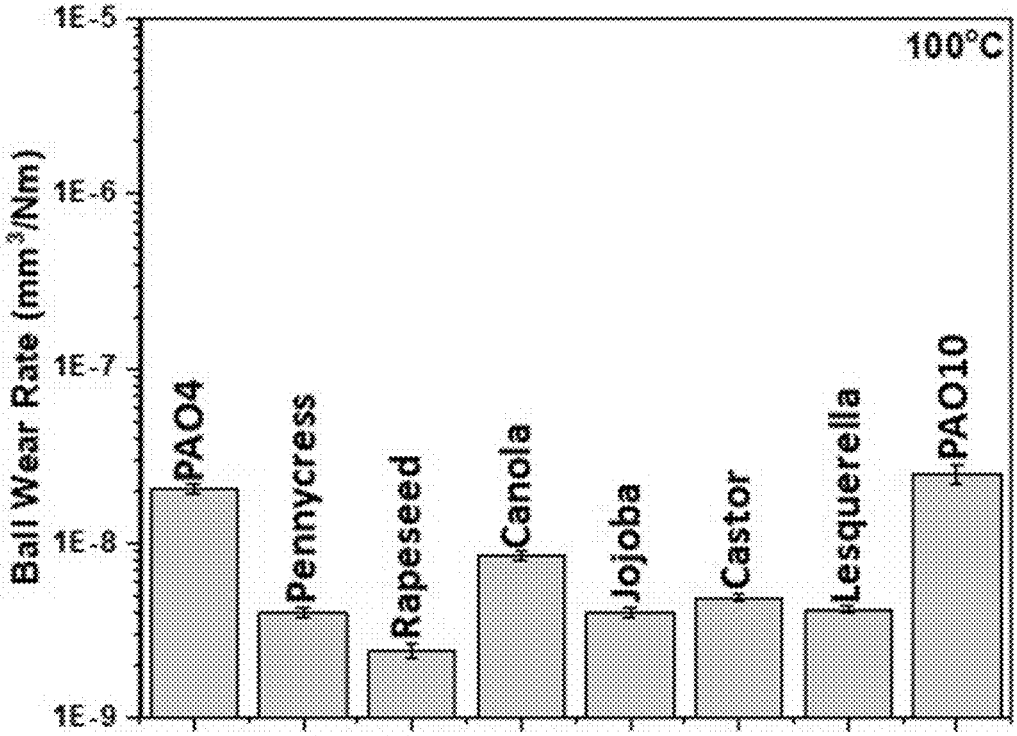
Figure 3C:
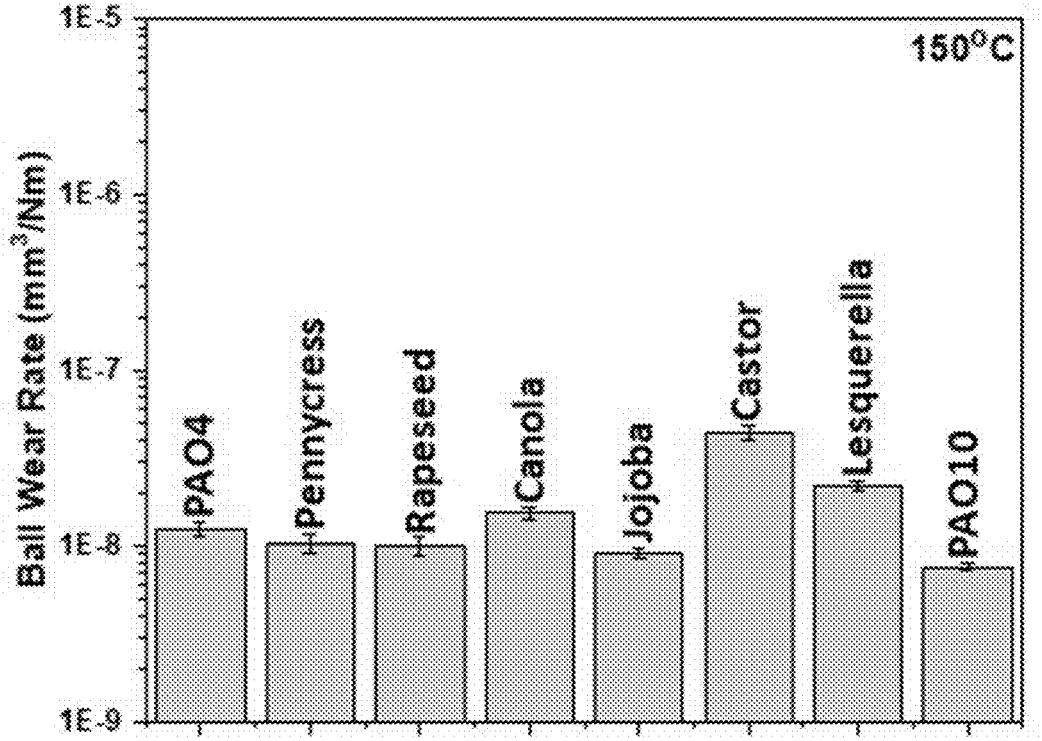
Figure 3D:
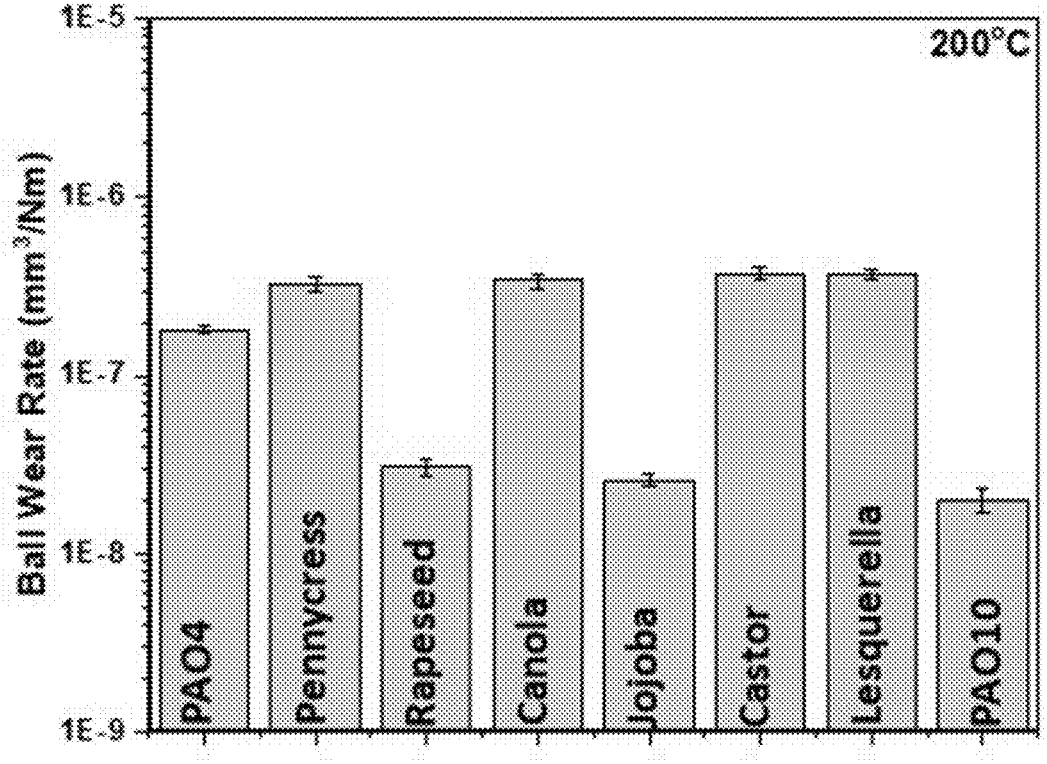
Figure 4A:
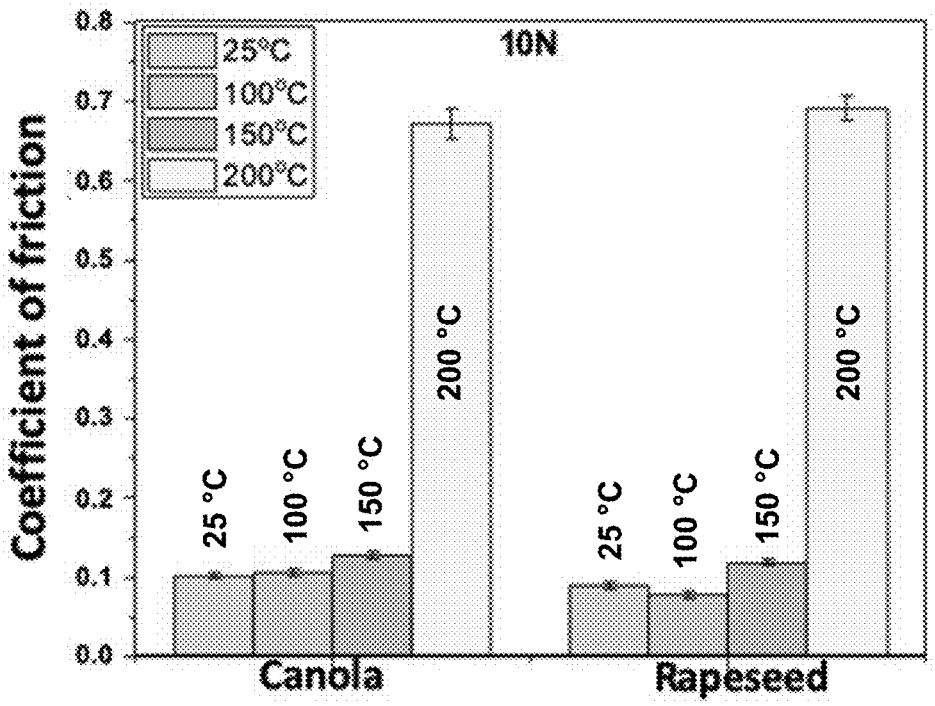
FIGS. 4A-4B shows representative coefficient of friction measurements (FIG. 4A) and ball wear rate measurements (FIG. 4B) for canola and rapeseed oil at a 10 N load and four different temperatures.
Figure 4B:
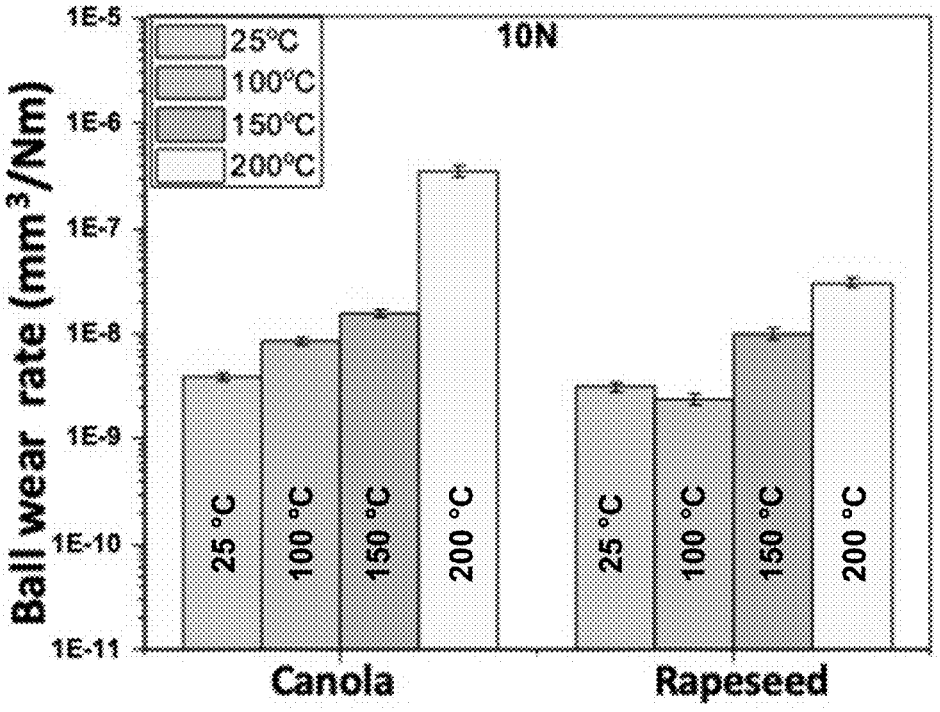
Figure 4C:
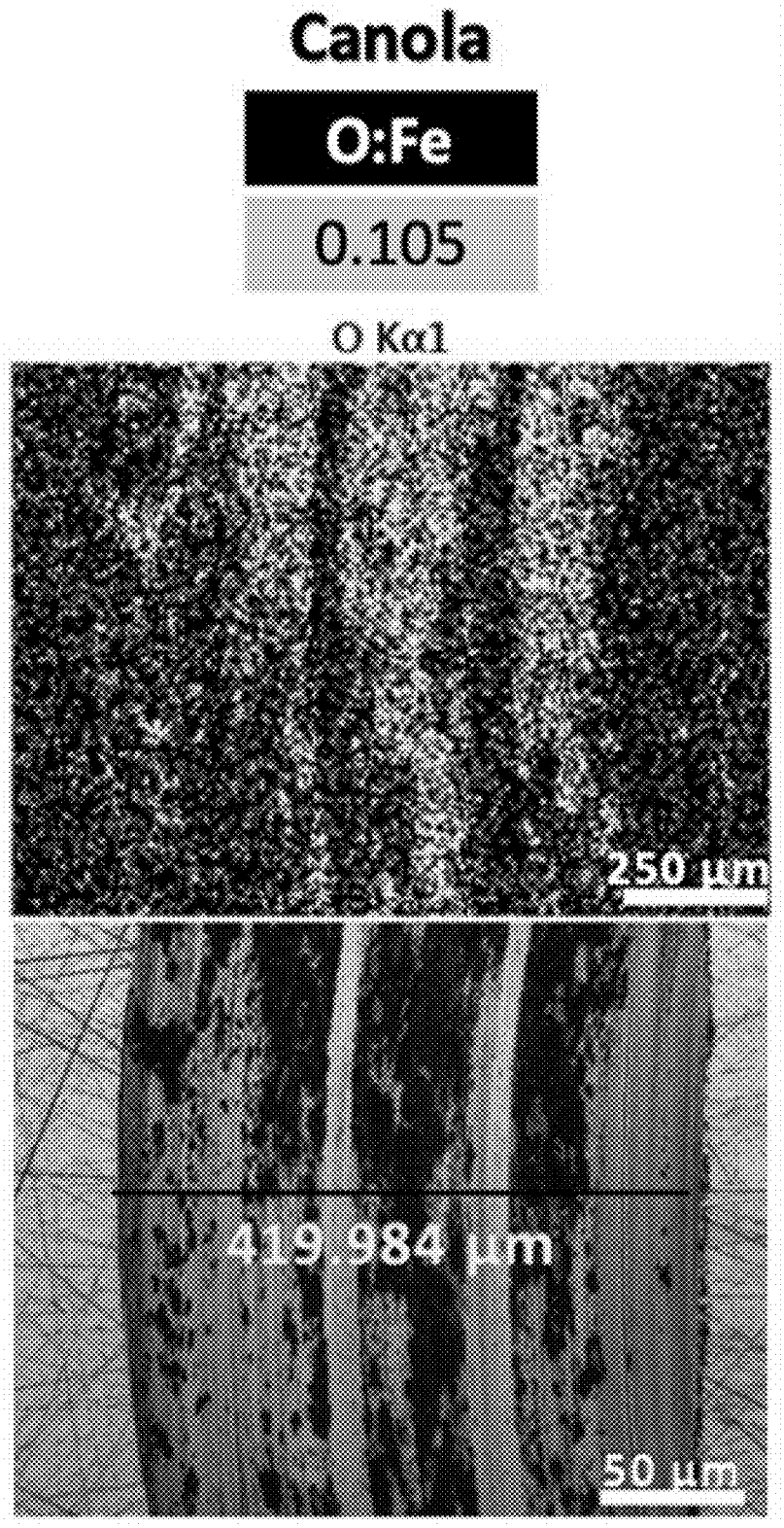
FIG. 4C-4D shows representative optical micrograph analyses of energy-dispersive X-ray spectroscopy and optical micrograph analyses of wear tracks formed for canola oil (FIG. 4C) and rapeseed oil (FIG. 4D) at 200° C. and a 10 N load.
Figure 4D:
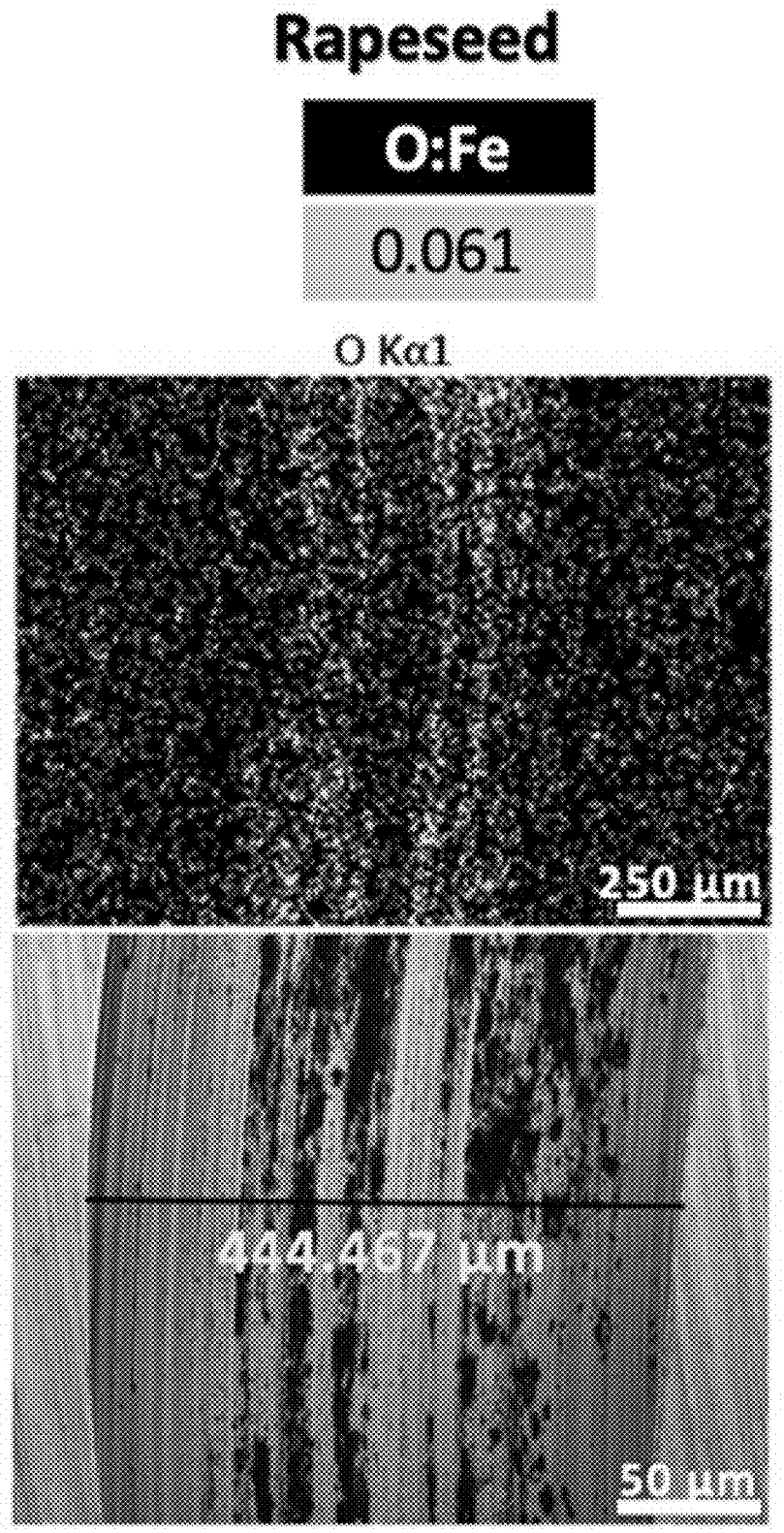

FIGS. 2A-2D summarize the stable COF values experienced by the sliding steel surfaces upon immersion in the oil. At lower temperatures (25° C. and 100° C.) all bio-oils demonstrated improvement in the COF values in comparison to PAO4 and PAO10. At 150° C., rapeseed oil performed relatively better than all other oils including PAO4 and PAO10. Upon increase in the temperature of the tribotests to 200° C., all oils exhibited COF values 35% to 45% higher than that of PAO4 and >45% higher than PAO10. Moreover, the COF values for all oils at 200° C. were substantially higher (five to six times higher) than their values at 150° C., being similar to the 25° C. and 100° C. COF values, demonstrating maximum lubricity occurred at 150° C. FIG. 2E is a schematic of the tribo-pairs lubricated by oil, it illustrates the position of the radius used for wear rate calculations of the steel ball.

FIGS. 3A-3D present a summary of the corresponding ball wear rates for tribology tests performed using seven different lubricants. The ball wear rates show a similar trend as the COF values, although wear rates were the lowest for the bio-oils at 25° C. and 100° C. whereas the lowest COF was at 150° C. (FIG. 2C). Notably, wear rates of the surfaces lubricated with rapeseed, jojoba, castor, or *lesquerella* oils at 25° C. were an order of magnitude lower in comparison to the synthetic PAO4 and PAO10 oils at 25° C. With the temperature increase to 100° C., the bio-oil candidates still performed better than the synthetic oils, with rapeseed and castor resulting in the lowest wear. Further increase in the temperature of the tests to 150° C. reduced wear rate values for all oils. At 200° C., the rapeseed, jojoba, and PAO10 oils performed the best, having wear rates lower than that of the other oils including PAO4.

It should be noted, that though jojoba oil demonstrated one of the best performances, it is more expensive when compared to the rest of the oil candidates studied in this paper and has very low viscosity, which compromises its effectiveness in applications. Castor oil also shows high oxidation resistivity along with high wear resistance and is already widely used as a lubricant. However, its extraction causes many health concerns due to potential exposure to the highly potent toxin, ricin, produced in the seed of the castor oil plant [33]. The inhalation of ricin can be lethal as only a few micrograms per kilogram of body weight corresponds to low survival rates [34].

A detailed comparison of canola versus rapeseed oils (FIGS. 4A-4D and previous figures) indicated overall better stability of the rapeseed oil. It is important to note that while both oils are comprised primarily of triacyglycerols, rapeseed oil has a higher erucic acid content (49.5% versus 1.6%), whereas the canola oil has higher polyunsaturated FA (PUFAs 18:2 and 18:3) content (27.8% versus 20.9%; Table 1). Erucic acid (22:1) is relatively more viscous than shorter chain and polyunsaturated FA. In addition, the double carbon bonds constituting PUFAs are prone to oxidation resulting in oil breakdown. Jojoba oil which exhibited relatively better oxidation stability and lubrication performance also has high erucic acid content though it is in the form of wax esters rather than in the form of triacylglycerols.

The results highlighted above suggest that the VLC FAs, erucic acid (C22:1) and eicosenoic acid (C20:1 cis), might play an important role in promoting the lubrication characteristics of the oil. To test this hypothesis, a comparison was performed of the performance of a wild-type pennycress oil (hereafter referred to as Pennycress oil), which has nearly 36% erucic acid content and 10% eicosenoic acid content, with the seed oil from the pennycress fatty acid elongase1 (fae1) mutant (herein referred to as Pennycress-LE) which contains only 3% of these VLC FAs (FIG. 5A) [35-36]. The structure and the resulting changes in the viscosity and OIT values of the pennycress and pennycress-LE oils are summarized in FIGS. 5A-5C. Notably, a decrease in the VLC FAs content demonstrated a decrease in both the viscosity and the OIT values. Specifically, according to FIG. 5C, the OIT decreased from 41 minutes for original Pennycress oil (that contains 35.7 mol % of C22:1 which refers to erucic acid) to 26 minutes for Pennycress-LE (that contains 1.8 mol % of C22:1). These results clearly indicate that the erucic acid has been shown to have a positive effect on the oxidation stability of plant-based oils because it has a higher melting point than other fatty acids which make it less prone to oxidation.

Figure 6A:
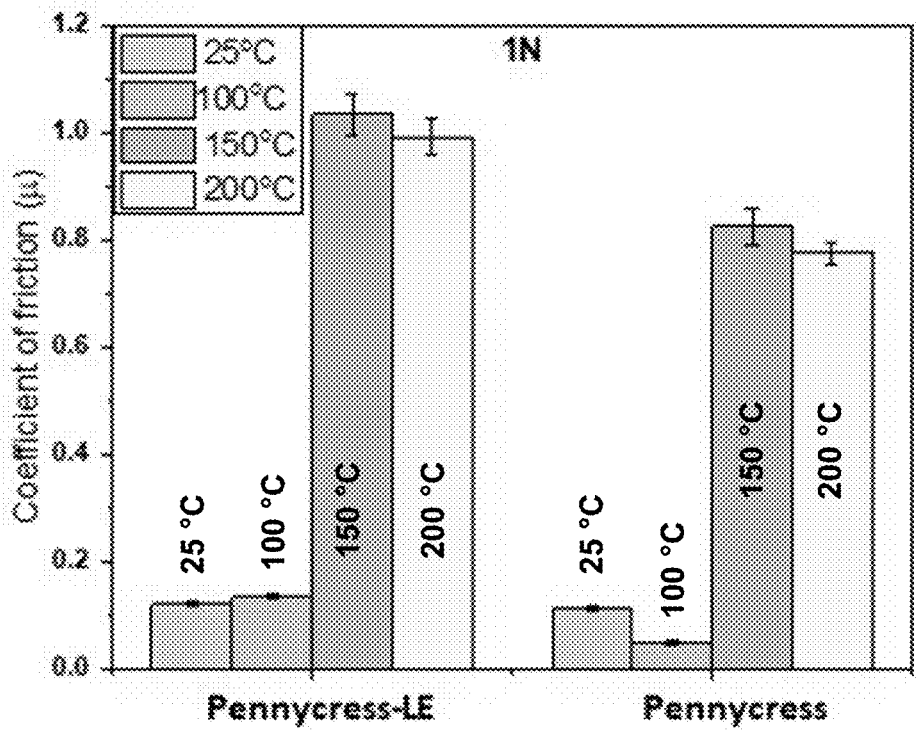
FIGS. 6A-6D show representative coefficient of friction measurements for pennycress-LE oil and pennycress oil at various temperatures both in air at 1 N (FIG. 6A), 10 N (FIG. 6B), and 20 N (FIG. 6C) and in a nitrogen atmosphere at 10 N (FIG. 6D).
Figure 6B:
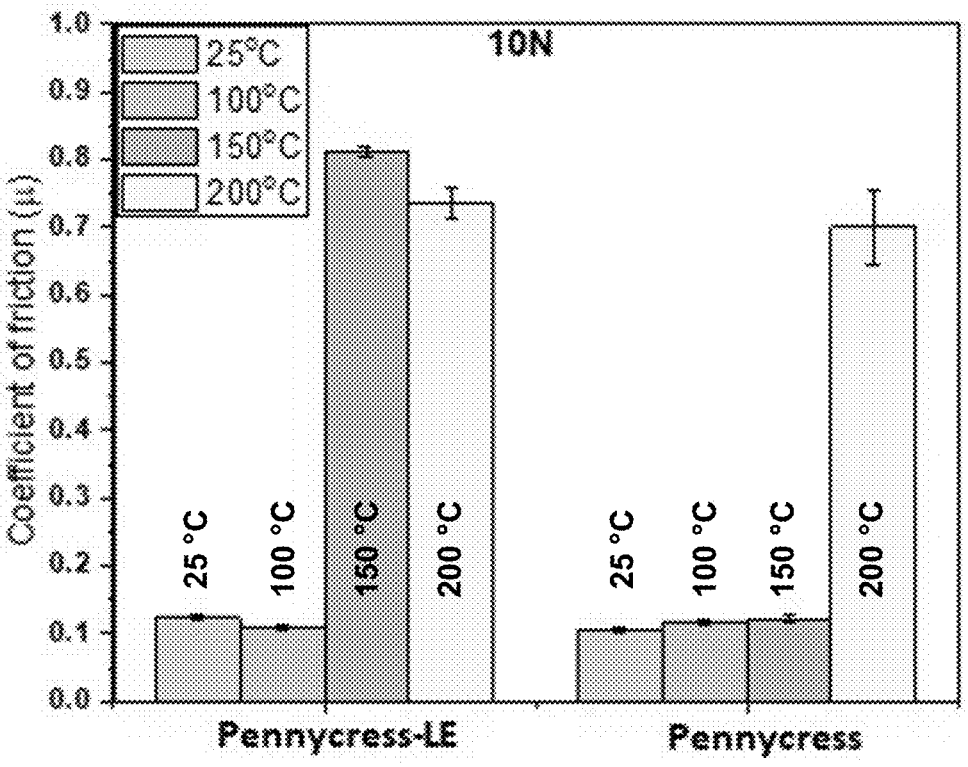
Figure 6C:
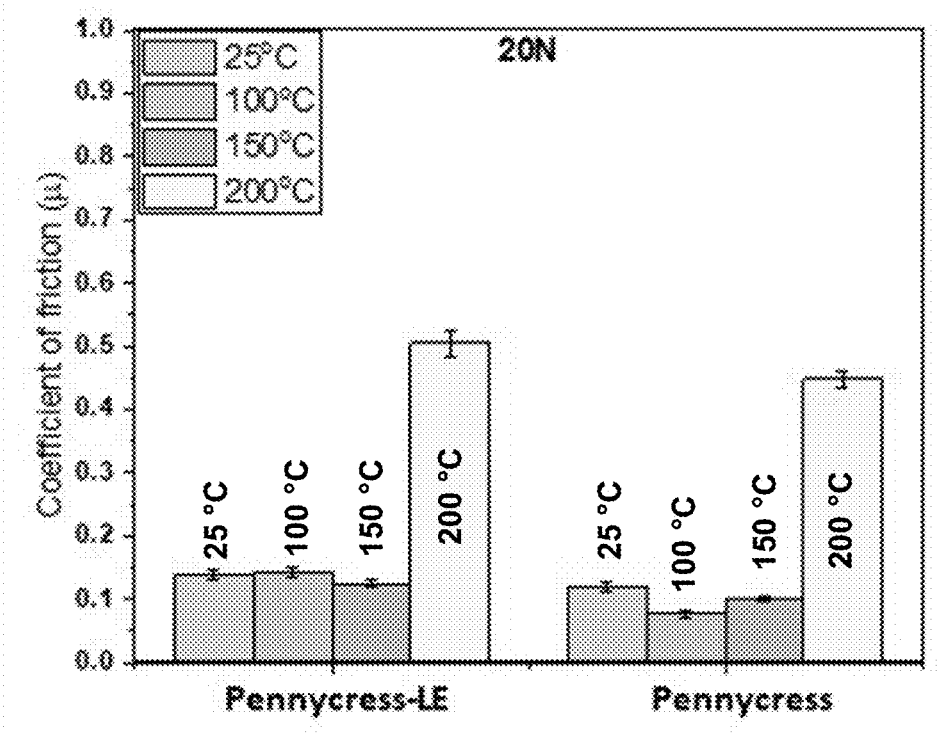
Figure 6D:
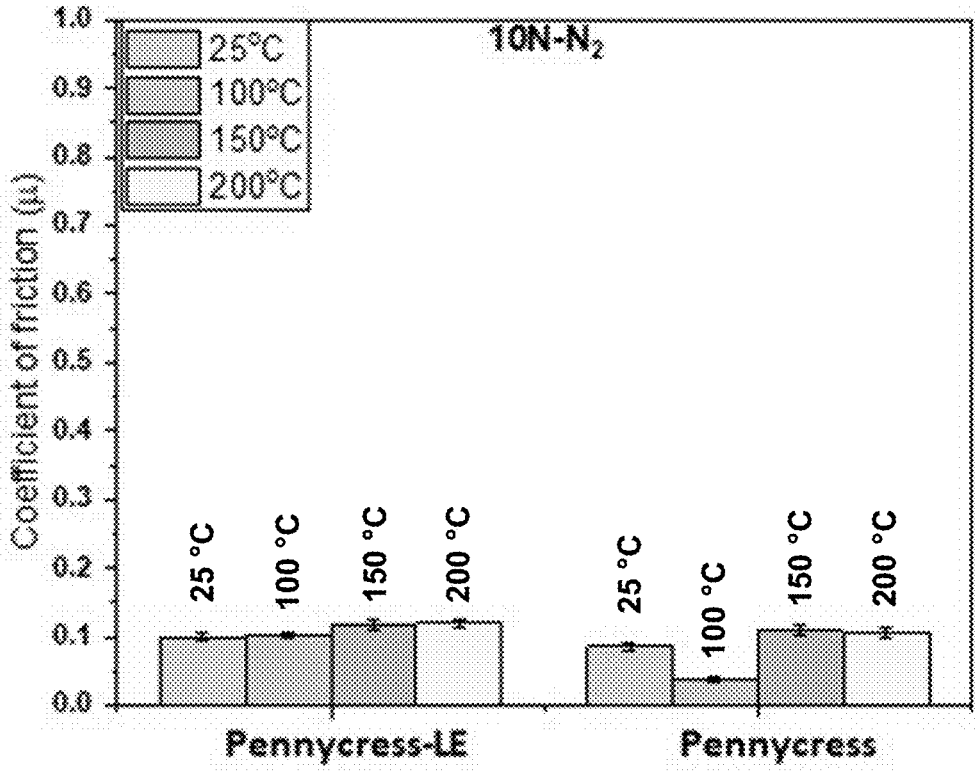
Figure 7A:
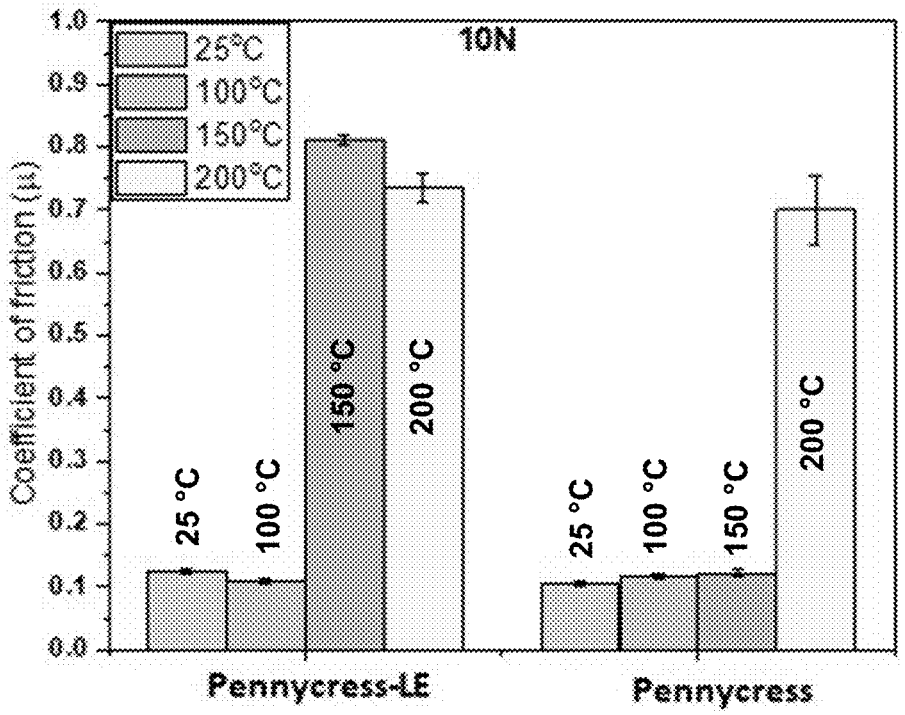
FIGS. 7A-7B show representative coefficient of friction measurements for pennycress-LE oil and pennycress oil at various temperatures both in air at 10 N (FIG. 7A) and in a nitrogen atmosphere at 10 N (FIG. 7B).
Figure 7B:
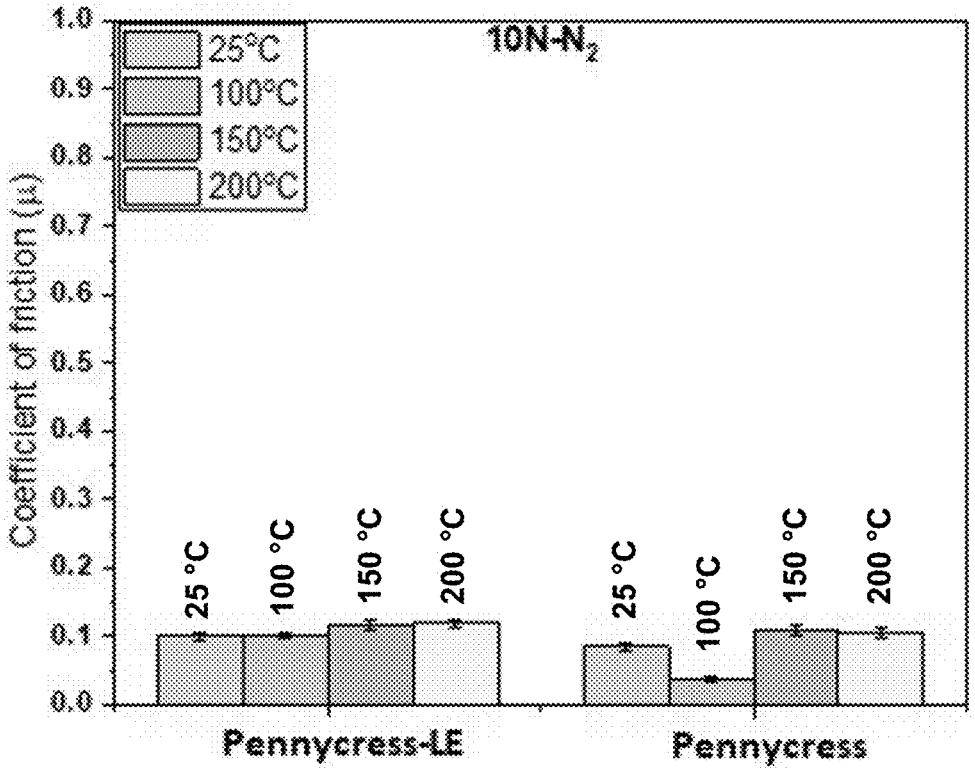
Figure 7C:
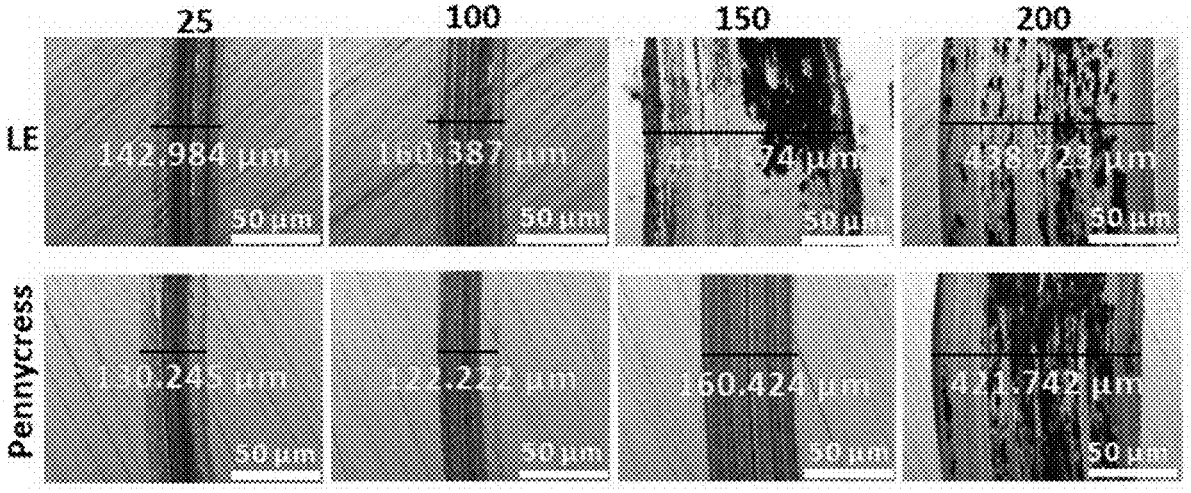
Figure 7D:
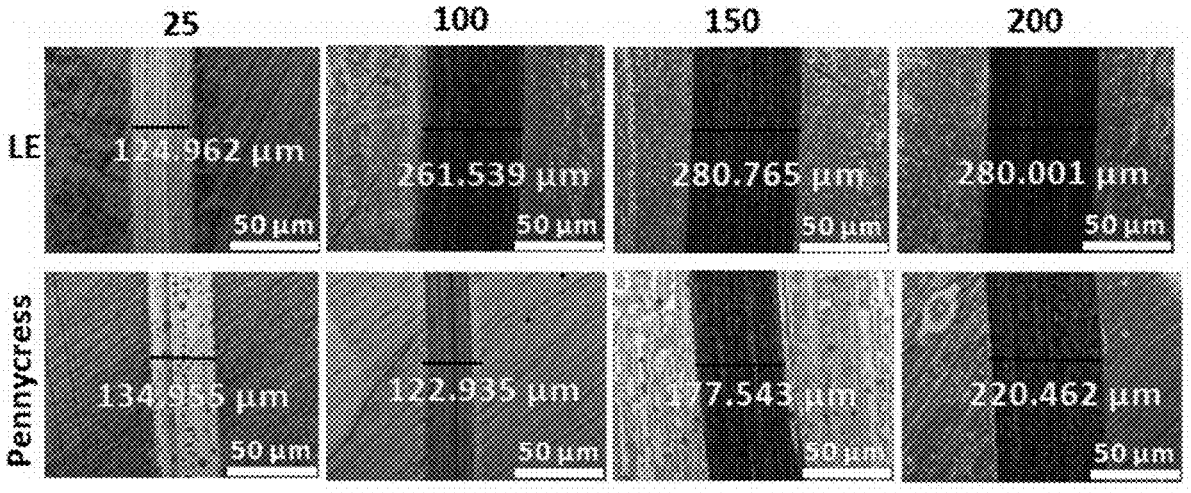

The Pennycress and Pennycress-LE oil samples were further analyzed for their lubrication characteristics. FIGS. 6A-6C show the values of COF performed at normal loads of 1 N, 10 N, and 20 N at different temperatures. Results indicated improvement in performance upon lubricating with the high erucic acid oil. Interestingly, the low erucic acid oil exhibits a lower failure temperature at 1N compared to 20N. This phenomenon could be attributed to the increased access of oxygen molecules inside the sliding contact area through the available surface of the oil exposed to the ambient atmosphere, which, as supported by the OIT analysis, can promote oxidation of the oil. Consistent with this hypothesis, the Pennycress-LE oil had a higher percentage of oxidatively unstable PUFAs compared to the pennycress oil (47.4% versus 28.9%). To eliminate the oxygen presence, the experimental setup was enclosed in the controlled environment chamber with constant nitrogen flow. Indeed, the COF analysis indicates improved lubrication performance of the oils, even up to 200° C. (FIG. 6D). For further comparison between the two different environments, FIGS. 7A-7D summarizes the corresponding optical micrographs of the wear tracks formed during sliding. Analyses indicated that the Pennycress oil showed higher stability at elevated temperatures leading to better lubrication efficiency and reduction in the wear of the steel surfaces. Even upon reduction of the oxygen presence in the environment, the overall performance of the Pennycress oil with high erucic acid and eicosenoic acid (VLC FAs) content demonstrated a reduction in the wear.

Figure 8A:
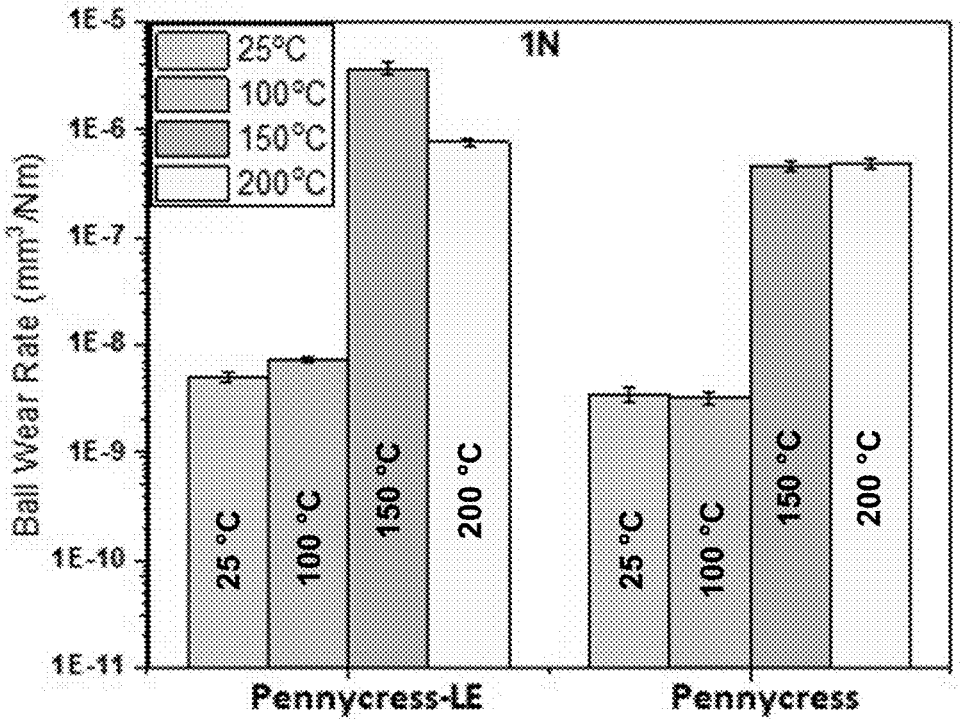
FIGS. 8A-8D show representative ball wear rate measurements at various temperatures of a 52100 steel surface used in reciprocating tribology tests for pennycress-LE oil and pennycress oil both in air at 1 N (FIG. 8A), 10 N (FIG. 8B), and 20 N (FIG. 8C) and in a nitrogen atmosphere at 10 N (FIG. 8D).
Figure 8B:
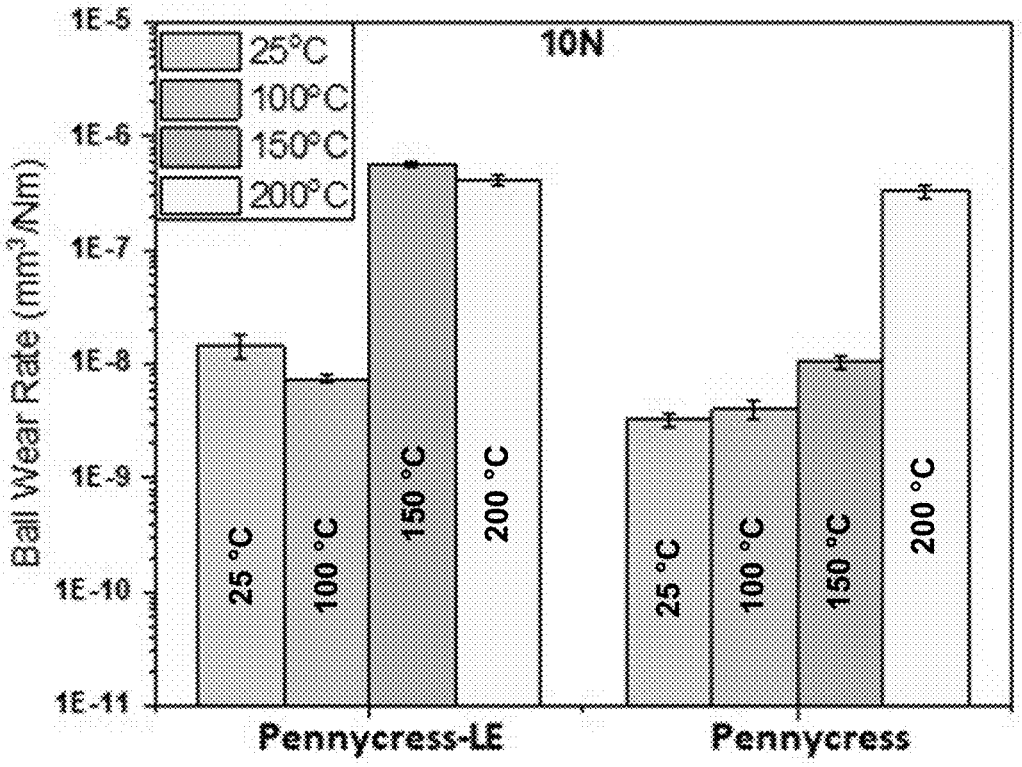
Figure 8C:
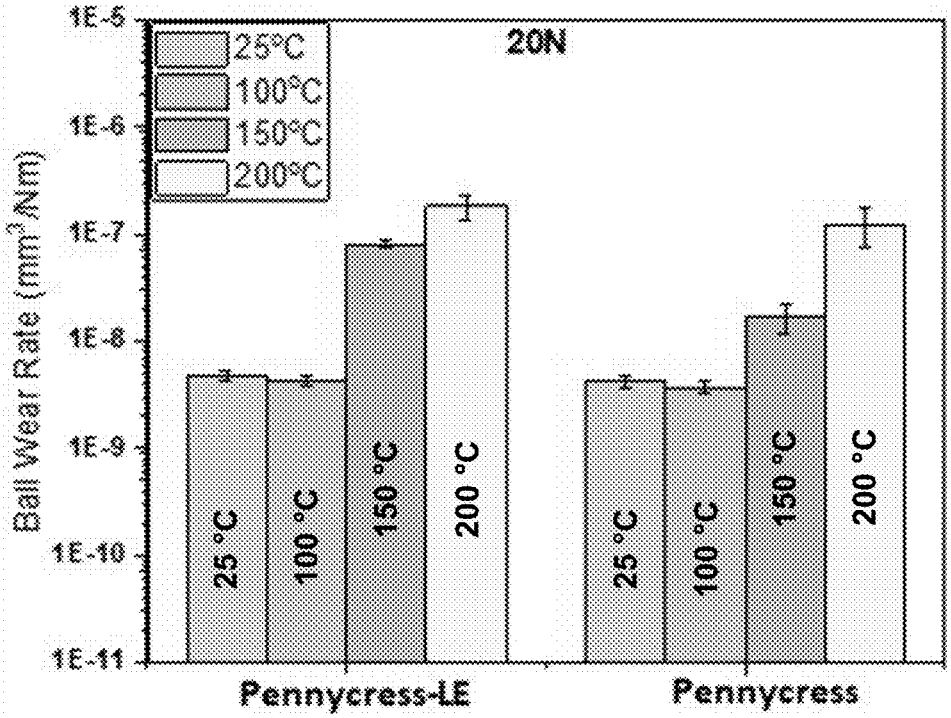
Figure 8D:
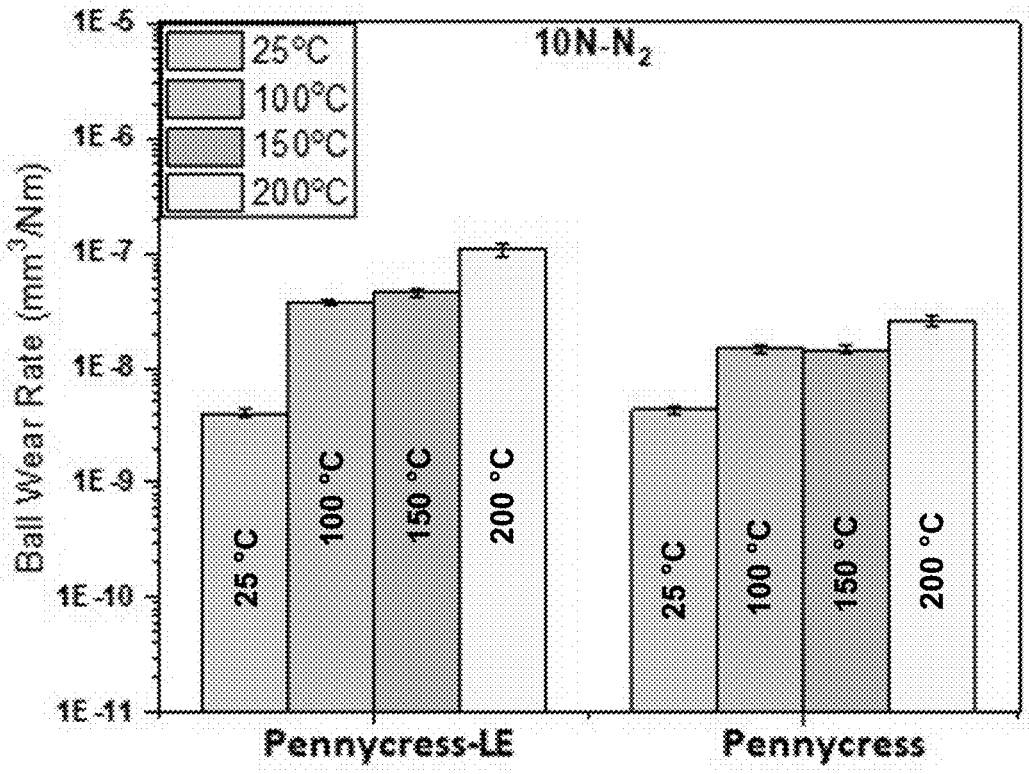

In FIGS. 8A-8C, Pennycress oil produced lower wear rate values than Pennycress-LE oil, especially at lower temperatures. The same trend occurred in the nitrogen environments at 10 N (FIG. 8D) in the absence of oxygen.

Figure 9A:
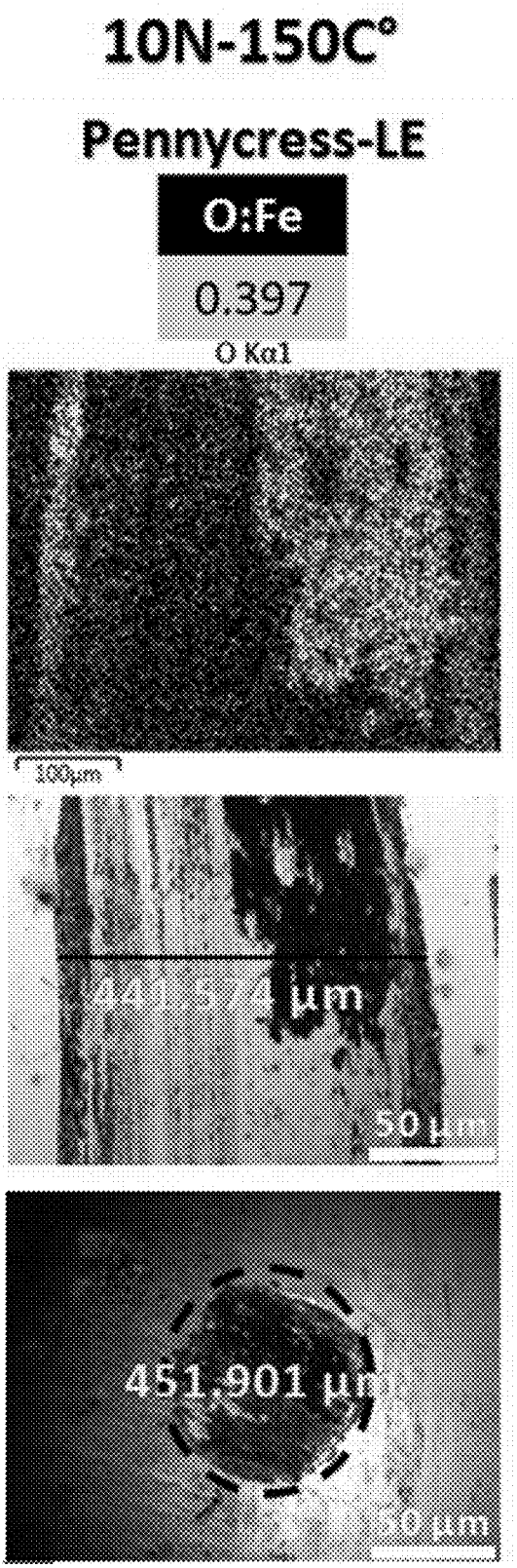
FIGS. 9A-9D show representative energy-dispersive X-ray spectroscopy and optical micrograph analyses of wear tracks formed in pennycress-LE oil at 150° C. using a 10 N load (FIG. 9A); pennycress oil at 150° C. using a 10 N load (FIG. 9B); pennycress oil in air at 200° C. using a 10 N load (FIG. 9C); and pennycress oil in a nitrogen atmosphere at 200° C. using a 10 N load (FIG. 9D).
Figure 9B:
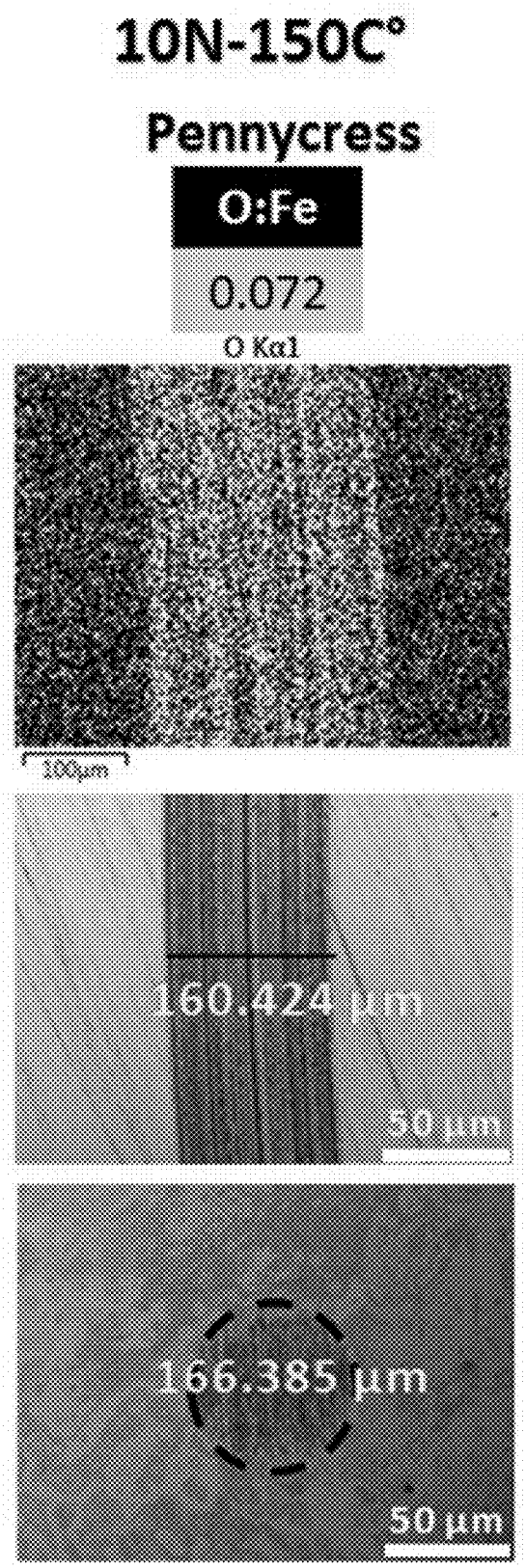
Figure 9C:
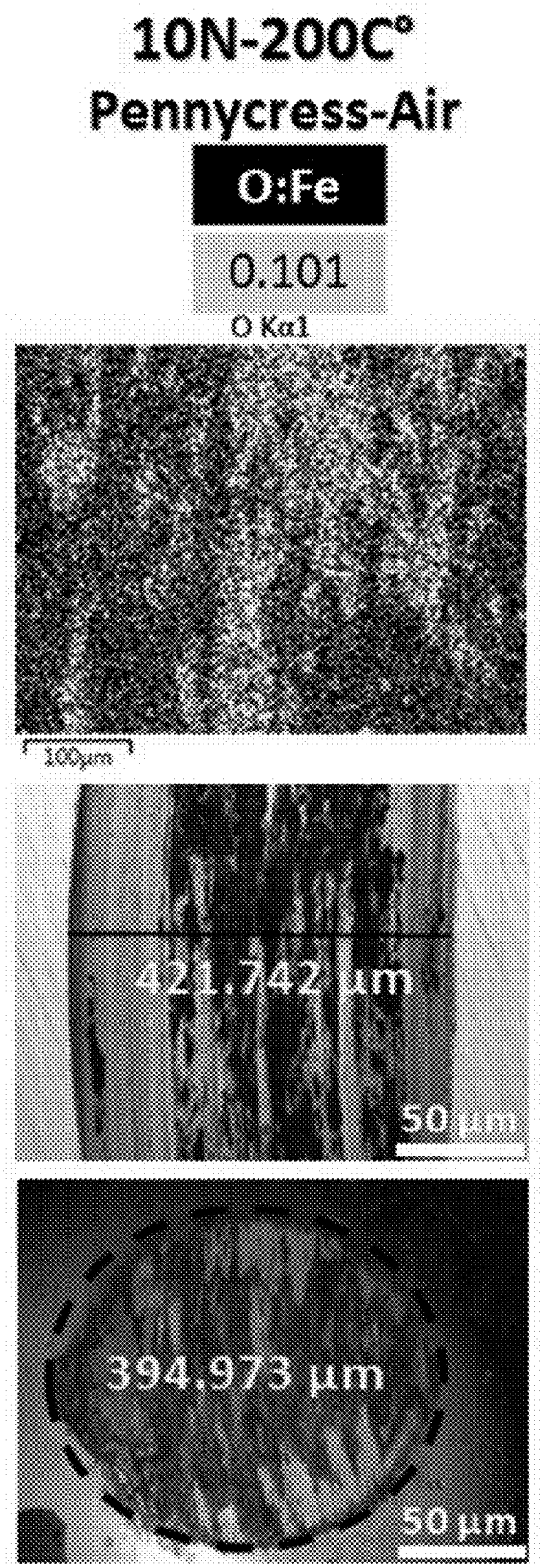
Figure 9D:
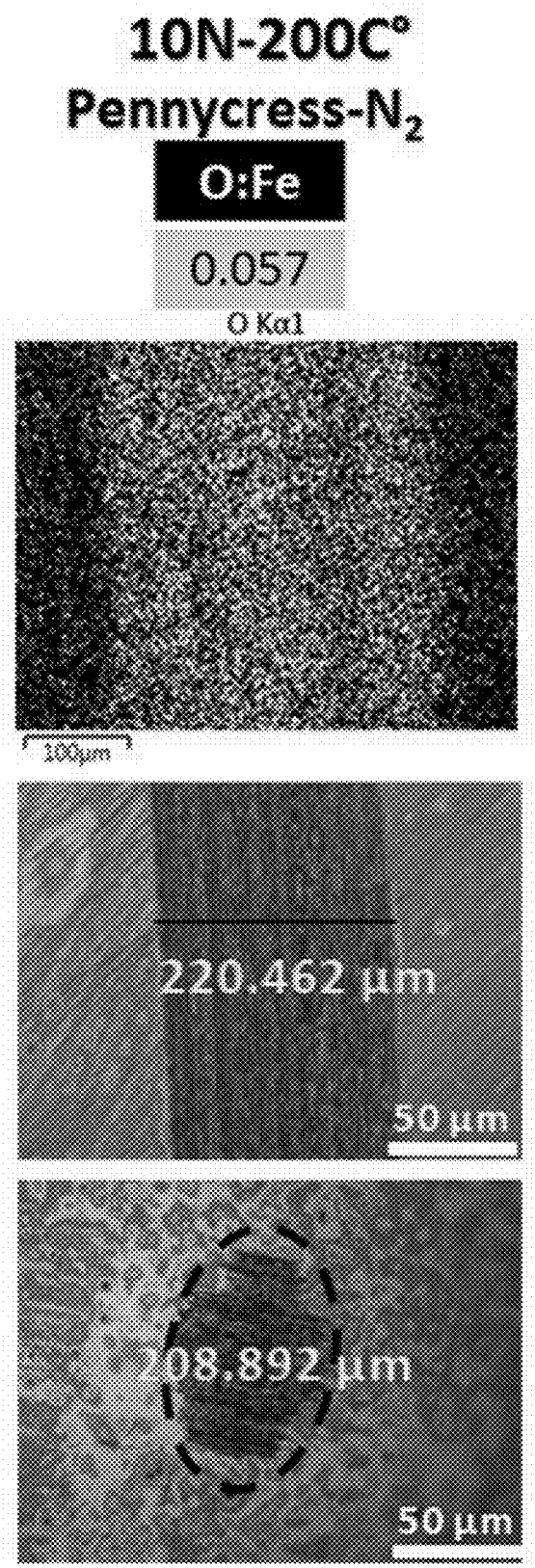

To quantitatively evaluate the effects of oxidation on the oil performance, an elemental analysis of the formed wear tracks was performed. FIGS. 9A-9B show a comparison between Pennycress-LE oil and Pennycress oil in terms of oxygen-to-iron ratio, the width of the wear track, and the radius of the ball wear track. Not only does the Pennycress oil show smaller wear tracks on both the substrate and the counterbody, but it also shows a lower O: Fe ratio which suggests that the higher percentage of erucic acid partly contributes to increased wear resistivity of the steel-steel contact lubricated by Pennycress oil. FIGS. 9C-9D shows the difference in O:Fe ratio for the wear tracks obtained from testing Pennycress oil in air and nitrogen using a 10 N load at 200° C. The results confirm the improved performance of the oil, though the oxygen presence is much reduced in comparison to the Pennycress-LE oil.

Figure 10A:
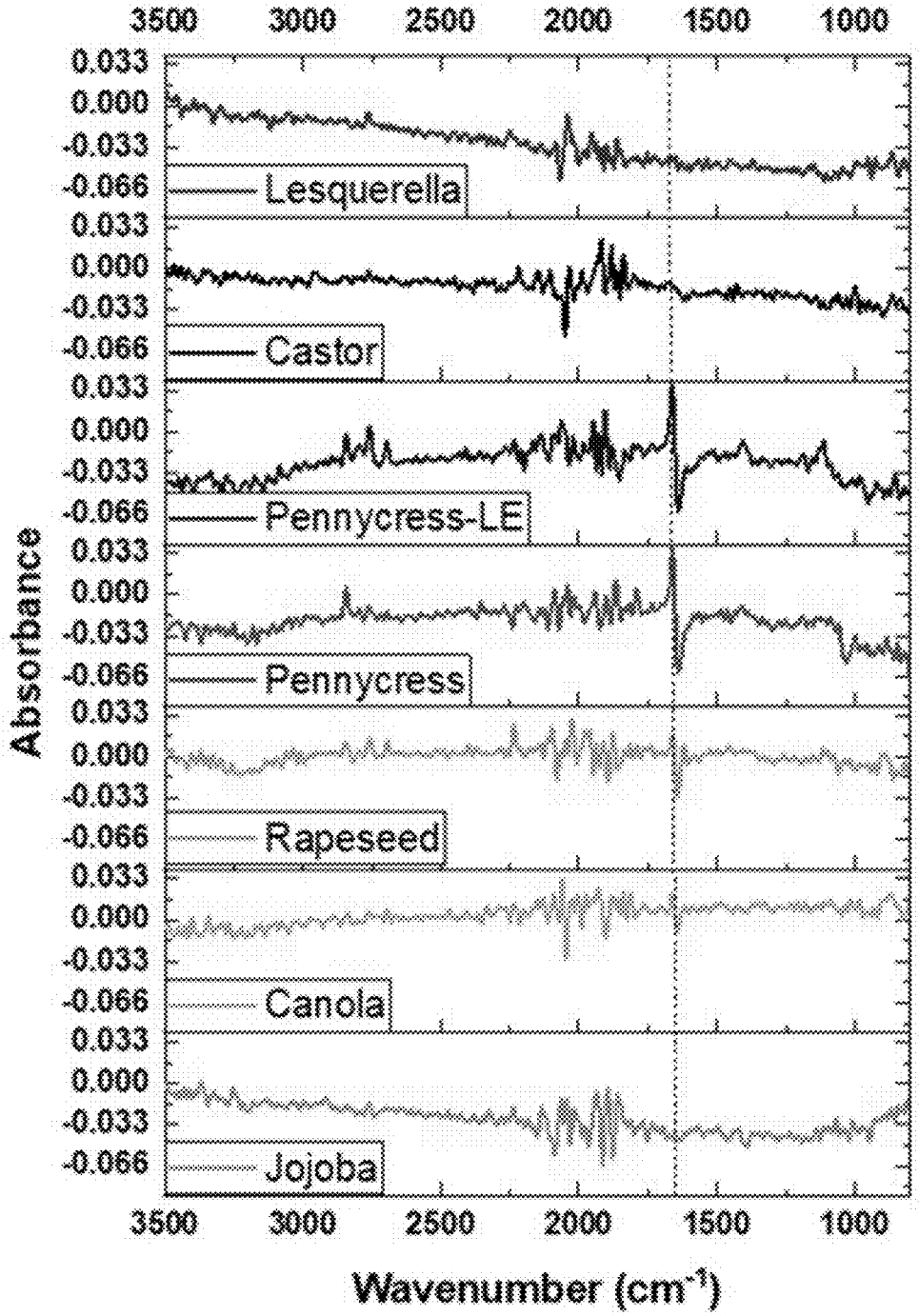
FIG. 10A-10B show representative FTIR spectra of bio-oil samples treated in a furnace at 200° for 1 hour (FIG. 10A) and original FTIR spectra at a low temperature (FIG. 10B).
Figure 10B:
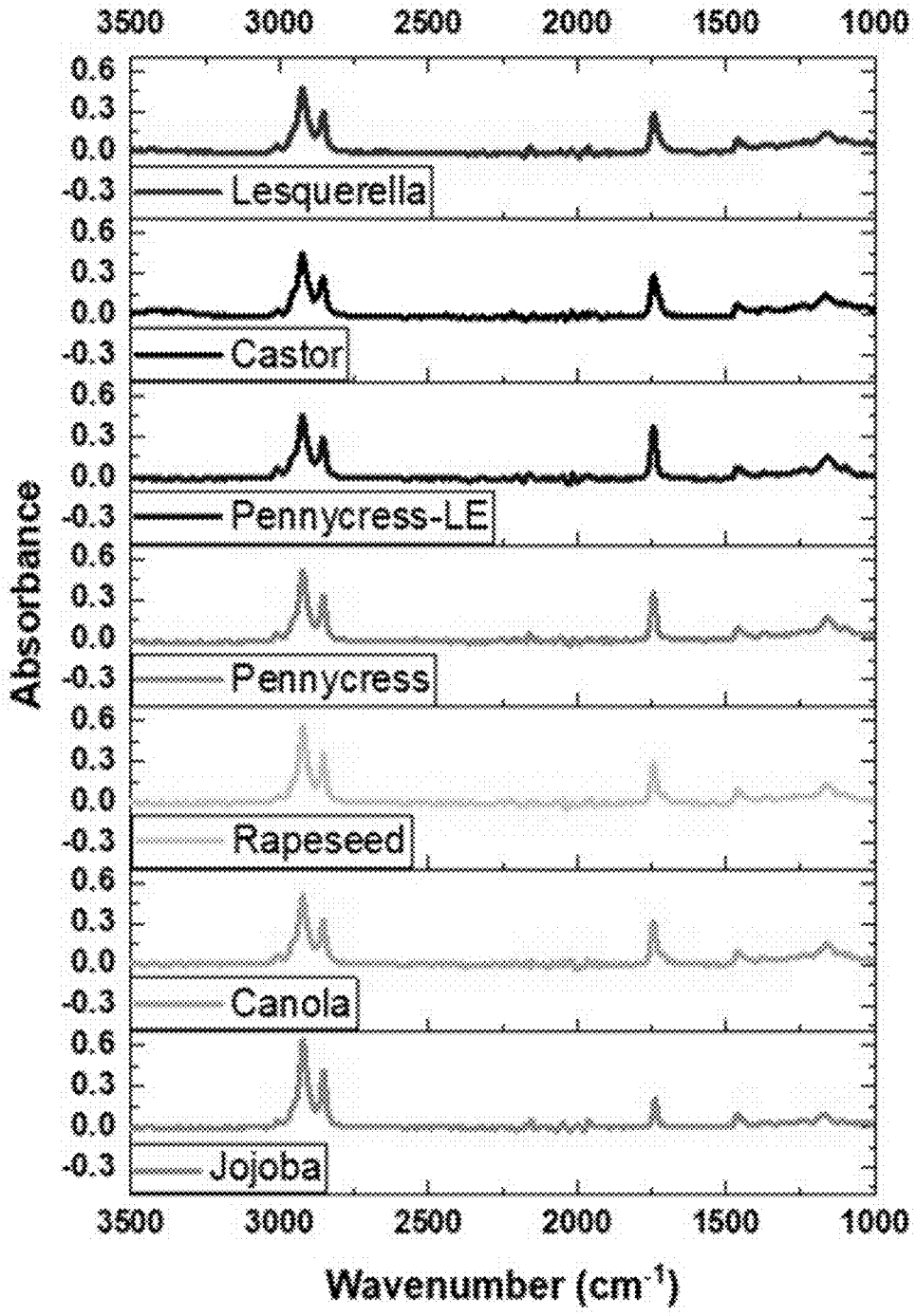

FIG. 10A shows the FTIR spectra results of the bio-oils treated at 200° C. in ambient environment to evaluate the stability of the oils exposed to elevated temperature conditions. FIG. 10B shows FTIR spectra of the oils prior to high temperature treatment. The change in absorbance at ~1660 $cm^{-1}$ wavenumber is associated with a stretching C═O in saturated carboxylic acids and stretching C═O in saturated esters, which is associated with aldehyde and ketone whose content increases with the degradation of frying oils [37-40]. The absence of peak 1660 $cm^{-1}$ in the FTIR spectra of jojoba, castor, and *lesquerella* oils suggests that these oils are more thermally stable than the rest of the bio-lubricants presented in this paper, and the variation of intensity of the same peak indicates that the canola and rapeseed oils exhibit greater thermal stability than the pennycress oils.

The results suggest that the presence of wax esters and fatty acids in plant-based lubricants is significantly affecting their lubrication mechanism. Plant-based lubricants containing VLC fatty acids and fatty alcohols offer high thermal and oxidative stability, reducing the likelihood of degradation or breakdown under harsh conditions and high temperatures. This stability contributes to the sustained performance of plant-based lubricants over time. The amount of erucic acid present in a plant-based lubricant plays a vital role in its tribological performance. A lubricant that contains a high concentration of erucic acid typically exhibits high viscosity, as demonstrated by the comparison between the composition of the bio-oils in Tables 1 and 2 and the dynamic viscosity analysis in FIG. 1A. This high viscosity, as a result, contributes to superior load-carrying capacity and excellent anti-wear properties. The long hydrocarbon chain of erucic acid is responsible for its ability to provide effective boundary lubrication and form a protective layer on the metal surface. The high molecular weight of the hydrocarbon chain allows erucic acid to spread evenly over the surface, forming a continuous lubricating film that reduces friction between the two surfaces in contact.

Figure 11A:
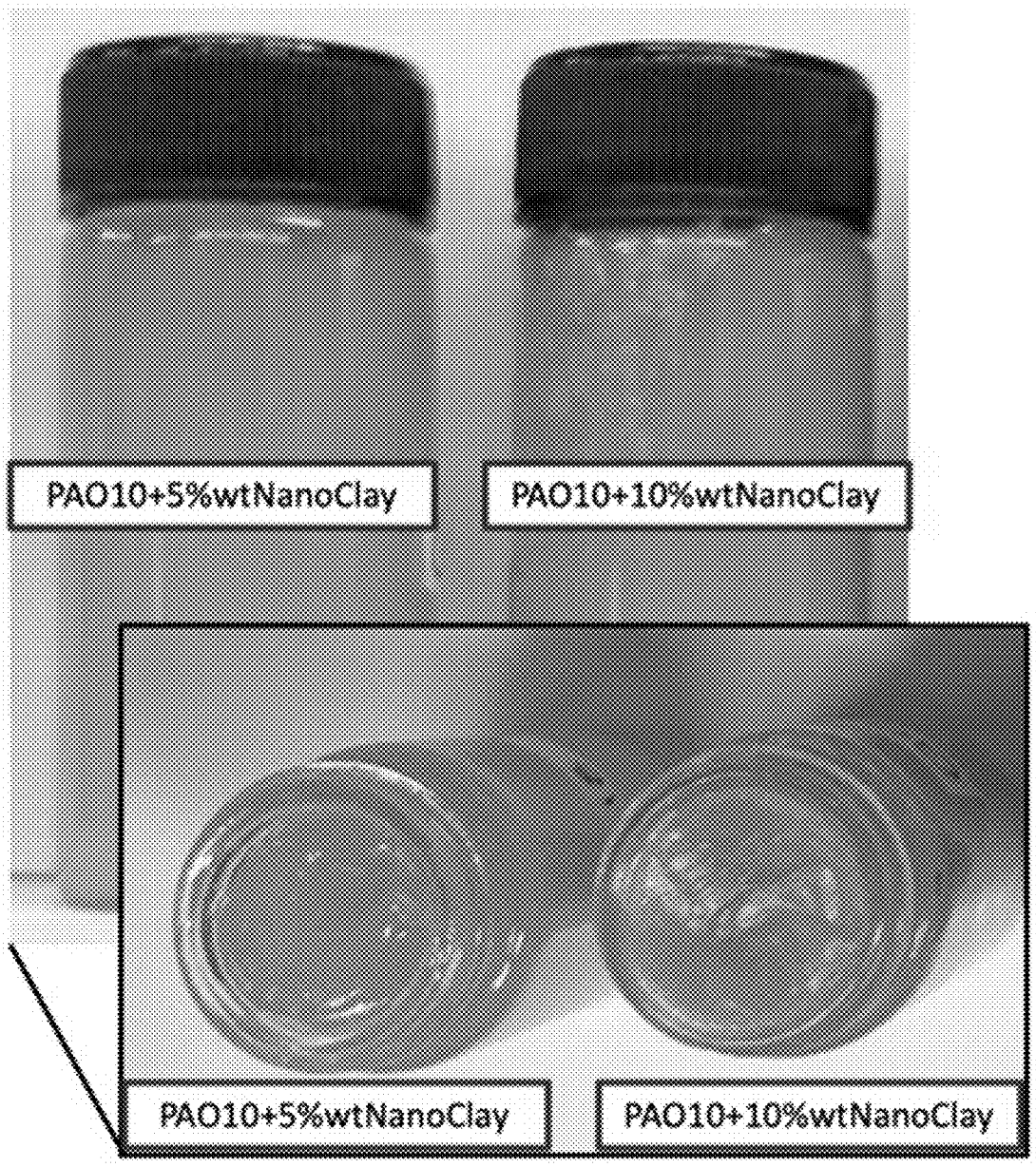
FIG. 11A shows photos of PAO10 oil samples containing nanoclay.
Figure 11B:
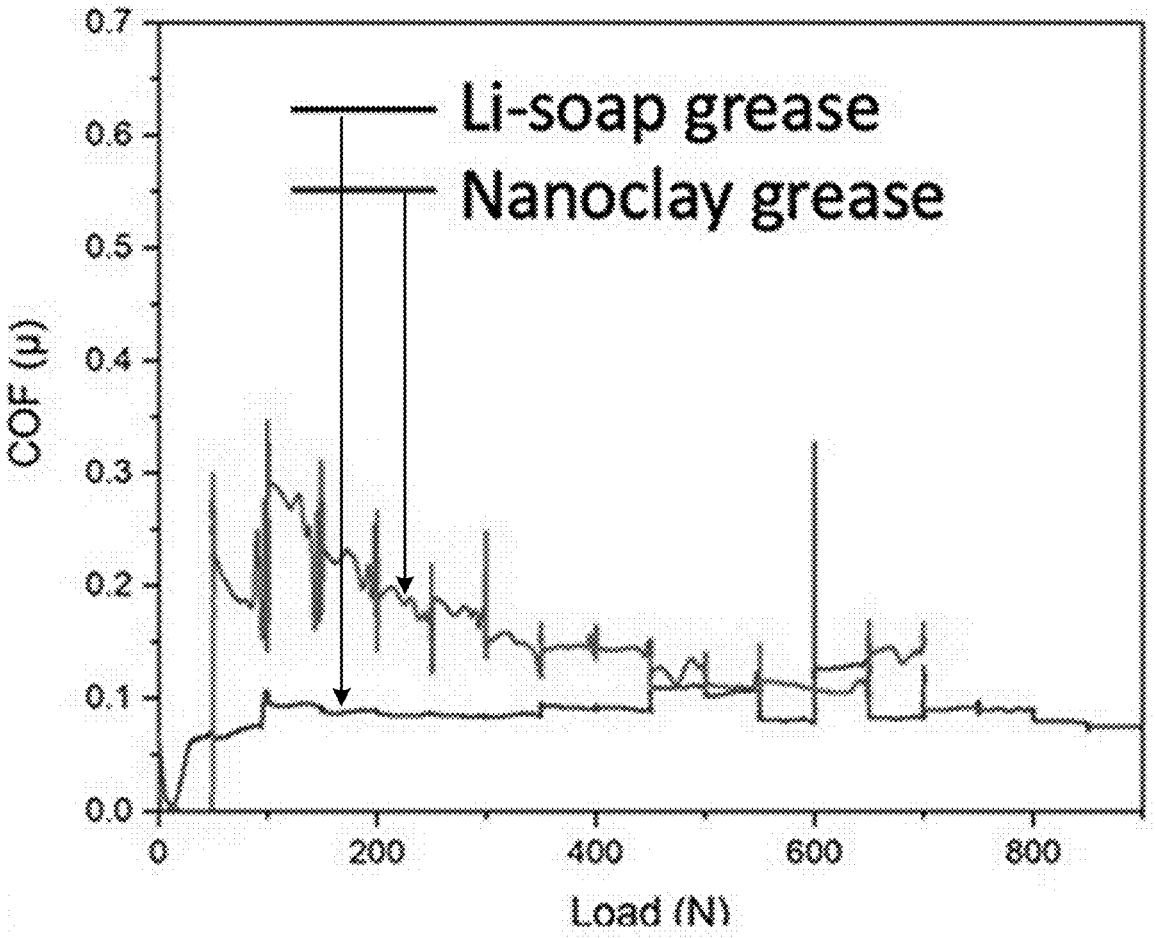
FIGS. 11B-11C show representative friction and storage modulus tests of PAO10 oils combined with either lithium soaps or nanoclay.
Figure 11C:
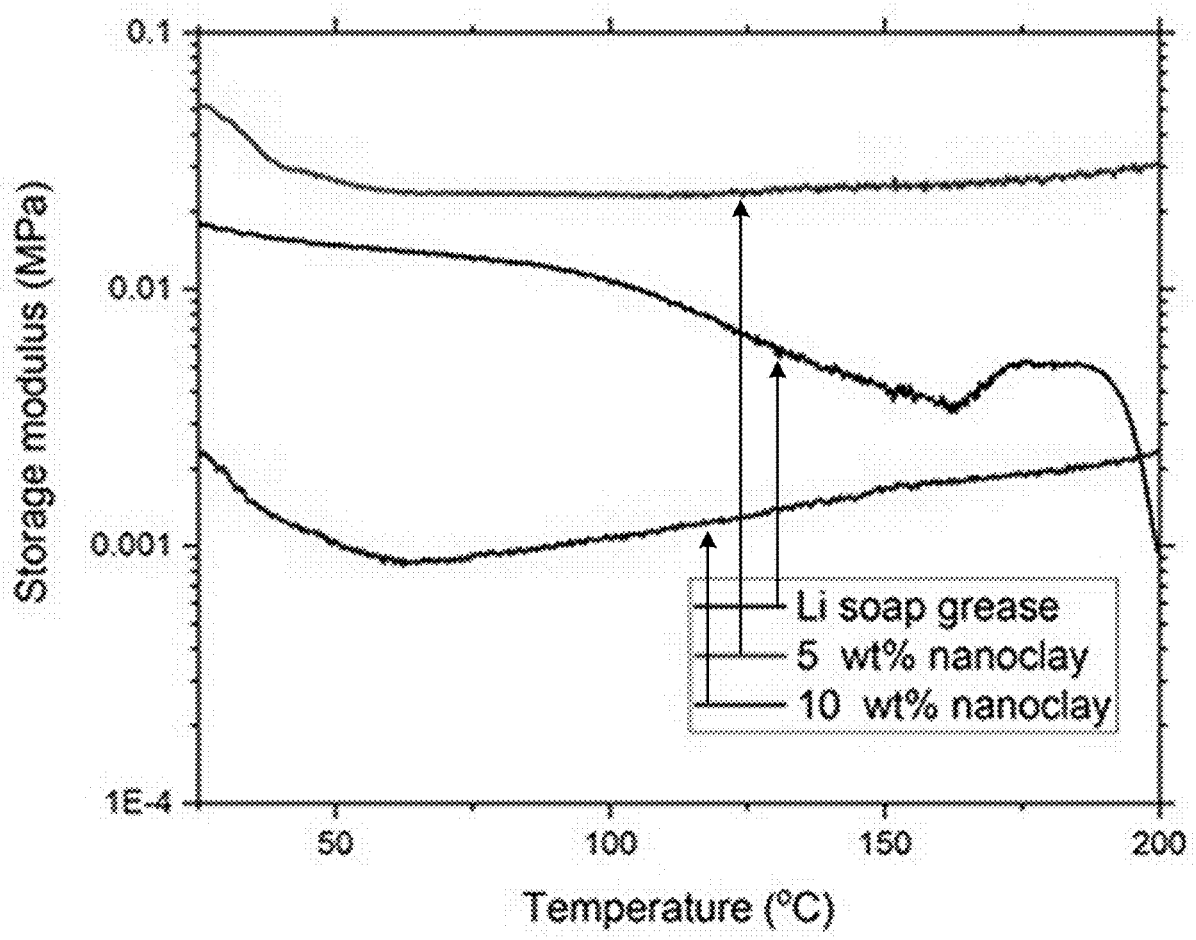

FIGS. 11A-11C show PAO10 oils combined with nanoclay and tribological comparisons to PAO10 oils combined with traditional lithium soaps.

Conclusions. Analysis of the lubrication potential of plant-based oil candidates from six plants was performed, namely pennycress, rapeseed, canola, jojoba, castor, and *lesquerella*, in comparison to the widely used synthetic PAO4 and PAO10 oils. Results indicated improved friction and wear characteristics of the bio-oils, with performance highly dependent on the testing temperature regime. These findings agree with the observed differences in the oxidation resistance of the oils as tested by the OIT analysis.

Further exploration of the lubrication characteristics of low-erucic acid pennycress oil, which has recently been developed for food and feed applications, was also performed. Results showed that low-erucic pennycress oil (Pennycress-LE) had relatively reduced viscosity and reduced oxidation resistance characteristics upon exposure to high-temperature tribology tests. The compromised oxidation resistance may be in part due to the higher polyunsaturated FA content of Pennycress-LE.

REFERENCES

[1] Holmberg, K., Andersson, P., & Erdemir, A. (2012). Global energy consumption due to friction in passenger cars. *Tribology International,* 47, 221-234. DOI: 10.1016/j.triboint.2011.11.022

[2] Mang, T. and Dresel, W. (2007). Lubricants and lubrication. John Wiley & Sons, Germany.

[3] Ayyagari, A., Alam, I., Berman, D., Erdemir, A. (2022). Progress in Superlubricity Across Different Media and Material Systems-A Review. Frontiers in Mechanical Engineering, DOI: 10.3389/fmech.2022.908497.

[4] Berman, D., Erdemir, A. (2021). Achieving Ultralow Friction and Wear by Tribocatalysis: Enabled by In-Operando Formation of Nanocarbon Films. ACS Nano 15, 18865. DOI: 10.1021/acsnano. 1c08170.

[5] Panchal, T. M., Patel, A., Chauhan, D. D., Thomas, M., & Patel, J. V. (2017). A methodological review on bio-lubricants from vegetable oil based resources. *Renewable and Sustainable Energy Reviews,* 70, 65-70 DOI: 10.1016/j.rser.2016.11.105

[6] Bartels, T., et al. (2000). Lubricants and lubrication. Ullmann's Encyclopedia of Industrial Chemistry.

[7] Shirani, A. et al., (2023). Promoted high-temperature lubrication and surface activity of polyolester lubricant with added phosphonium ionic liquid. Tribology International 180, 108287, DOI: 10.1016/j.triboint.2023.108287.

[8] Kumar, A. N., & Natarajan, S. (2018). Performance evaluation of epoxidized vegetable oils as cutting fluids in turning AA6061 with minimal quantity lubrication. Advances in Tribology, 2018. DOI: 10.1155/2018/2425619

[9] Mortada, H. A., & Hassan, M. K. (2020). Electrospun soy protein isolate/polyethylene oxide blended membranes for wound dressing applications. *European Journal of Pharmaceutics and Biopharmaceutics,* 157, 1-10. DOI: 10.1016/j.ejpb.2020.09.003

[10] Martin-Alfonso, M. J., Mejía, A., Martínez-Boza, F. J., & Martin-Alfonso, J. E. (2021). Rheological characterization of sepiolite-vegetable oil suspensions at high pressures. *Journal of Molecular Liquids,* 327, 114105. DOI: 10.1016/j.molliq.2020.114105

[11] Wang, X., et al. (2020). Vegetable oil-based nanofluid minimum quantity lubrication turning: Academic review and perspectives. *Journal of Manufacturing Processes,* 59, 76-97. DOI: 10.1016/j.jmapro.2020.09.044

[12] Yin, Q. et al. (2021). Effects of physicochemical properties of different base oils on friction coefficient and surface roughness in MQL Milling AISI 1045. *International Journal of Precision Engineering and Manufacturing Technology,* 8 (6), 1629-1647. DOI: 10.1007/s40684-021-00295-8

[13] Ma, Q. et al. (2022). Preparation and application of an environmentally friendly compound lubricant based biological oil for drilling fluids. *Arabian Journal of Chemistry,* 15 (3). DOI: 10.1016/j.arabjc.2021.107193

[14] Fox, N. J., & Stachowiak, G. W. (2007). Vegetable oil-based lubricants—A review of oxidation. *Tribology International,* 40 (2), 103-110. DOI: 10.1016/j.triboint.2006.10.002

[15] Sharma, B. K., Doll, K. M., & Erhan, S. Z. (2008). Ester hydroxy derivatives of methyl oleate: Tribological, oxidation and low temperature properties. *Bioresource Technology,* 99 (15), 7333-7340. DOI: 10.1016/j.biortech.2007.12.057

[16] Asadauskas, S., Perez, J. M., & Duda, J. L. (1997). Lubrication properties of castor oil—Potential basestock for biodegradable lubricants. *Tribology Transactions,* 40 (4), 651-658, DOI: 10.1080/10402009708983526

[17] Asadauskas, S., Perez, J. M., & Duda, J. L. (1998). Oxidative stability and antiwear properties of high oleic vegetable oils. *Journal of the American Oil Chemists' Society,* 75 (4), 547-552, DOI: 10.1007/s11746-998-0085-5

[18] Kozma, M. (1997). Investigation into the scuffing load capacity of environmentally-friendly lubricating oils. *Journal of Synthetic Lubrication,* 14 (3), 249-258, DOI: 10.1002/jsl.3000140307

[19] Odi-Owei, S. (1988). Tribological properties of some vegetable oils and fats. *Journal of Lubrication Engineering,* 45 (11), 685-690.

[20] Romsdahl, T. et al. (2019) "Nature-Guided Synthesis of Advanced Bio-Lubricants", *Nature Scientific Reports* 9, 1171, DOI: 10.1038/s41598-019-48165-6.

[21] Li, X. et al. (2018) "Discontinuous Fatty Acid Elongation Yields Hydroxylated Seed Oil with Improved Function", *Nature Plants* 4, 711-720, DOI: 10.1038/s41477-018-0225-7

[22] Saleh, H. E., & Selim, M. Y. E. (2017). Improving the performance and emission characteristics of a diesel engine fueled by jojoba methyl ester-diesel-ethanol ternary blends. *Fuel,* 207, 690-701. DOI: 10.1016/j.fuel.2017.06.072

[23] Shirani, A. (2020) "Lubrication characteristics of wax esters from oils produced by a genetically-enhanced oilseed crop", *Tribology International* 146, 106234, DOI: 10.1016/j.triboint.2020.106234

[24] Suthar, K., Singh, Y., Surana, A. R., Rajubhai, V. H., & Sharma, A. (2020). Experimental evaluation of the friction and wear of jojoba oil with aluminium oxide (al2o3) nanoparticles as an additive. *Materials Today: Proceedings,* 25, 699-703. DOI: 10.1016/j.matpr.2019.08.150

[25] Durak, E. (2004). A study on friction behavior of rapeseed oil as an environmentally friendly additive in lubricating oil. *Industrial Lubrication and Tribology,* 56 (1), 23-37. DOI: 10.1108/00368790410515362

[26] Van Gerpen, J. H., & He, B. B. (2014). Biodiesel and renewable diesel production methods. *Advances in Biorefineries,* 441-475. DOI: 10.1533/9780857097385.2.441

[27] Zeng, Q. (2022). The lubrication performance and viscosity behavior of castor oil under high temperature. *Green Materials,* 10 (2), 51-58. DOI: 10.1680/jgrma.20.00068

[28] Cermak, S. C., Biresaw, G., Isbell, T. A., Evangelista, R. L., Vaughn, S. F., & Murray, R. (2013). New crop oils—Properties as potential lubricants. Industrial Crops and Products, 44, 232-237. DOI: 10.1016/j.indcrop.2012.10.035

[29] Cocuron, J.-C. et al. (2014) "Targeted metabolomics of physaria *fendleri*, an industrial crop producing hydroxy fatty acids," Plant and Cell Physiology, 55 (3), pp. 620-633, DOI: 10.1093/pcp/pcu011

[30] Arias, C. L. et al. (2022) "Expression of atwri1 and atdgat1 during soybean embryo development influences oil and carbohydrate metabolism," Plant Biotechnology Journal, 20 (7), pp. 1327-1345, DOI: 10.1111/pbi.13810.

[31] Johnston, C. et al. (2022) "Effective mechanisms for improving seed oil production in pennycress (*Thlaspi arvense* L.) highlighted by integration of comparative metabolomics and Transcriptomics," Frontiers in Plant Science, 13, DOI: 10.3389/fpls.2022.943585.

[32] Yan, Z., Jiang, D., Fu, Y., Qiao, D., Gao, X., Feng, D., Sun, J., Weng, L., & Wang, H. (2018). Vacuum tribological performance of WS2-MoS2 composite film against oil-impregnated porous polyimide: Influence of oil viscosity. Tribology Letters, 66 (4), 146. DOI: 10.1007/s11249-018-1081-1

[33] Sousa, N. L. et al. (2017) "Bio-detoxification of ricin in castor bean (*Ricinus communis* L.) seeds," Scientific Reports, 7 (1), DOI: 10.1038/s41598-017-15636-7.

[34] Worbs, S. et al. (2011) "*Ricinus communis* intoxications in human and veterinary medicine—a summary of real cases," Toxins, 3 (10), pp. 1332-1372, DOI: 10.3390/toxins3101332.

[35] McGinn, M. et al. (2018) "Molecular tools enabling pennycress (*Thlaspi arvense*) as a model plant and oilseed cash cover crop," Plant Biotechnology Journal, 17 (4), pp. 776-788, DOI: 10.1111/pbi. 13014.

[36] Chopra, R. et al. (2020) "Identification and stacking of crucial traits required for the domestication of pennycress," Nature Food, 1 (1), pp. 84-91, DOI: 10.1038/s43016-019-0007-z.

[37] Zhang, H. et al. (2015) "Analysis of carbonyl value of frying oil by Fourier transform infrared spectroscopy," Journal of Oleo Science, 64 (4), pp. 375-380, DOI: 10.5650/jos.ess14201.

[38] Asemani, M. and Rabbani, A. R. (2020) "Detailed FTIR spectroscopy characterization of crude oil extracted asphaltenes: Curve resolve of overlapping bands," Journal of Petroleum Science and Engineering, 185, p. 106618, DOI: 10.1016/j.petrol.2019.106618.

[39] Lerma-García, M. J. et al. (2010) "Authentication of extra virgin olive oils by fourier-transform infrared spectroscopy," Food Chemistry, 118 (1), pp. 78-83, DOI: 10.1016/j.foodchem.2009.04.092.

[40] Sim, S. F. et al. (2014) "Synchronized analysis of FTIR SPECTRA and GCMS chromatograms for evaluation of the thermally degraded vegetable oils," Journal of Analytical Methods in Chemistry, 2014, pp. 1-9, DOI: 10.1155/2014/271970.

Many variations and modifications may be made to the above-described aspects. All such modifications and variations are intended to be included herein within the scope of this disclosure and protected by the following claims.

What is claimed:

1. A lubricant composition, comprising an oil, a wax, or a combination thereof, wherein at least one of the oil or the wax comprises a very long chain fatty acid (VLC FA), wherein the VLC FA comprises about 30% to about 80% by weight of a total weight of the oil or the wax; and wherein at least one of the oil or the wax has been modified to increase a concentration of the VLC FA relative to a reference concentration of the VLC FA in the oil or the wax without the modification.

2. The lubricant composition of claim 1, wherein the oil or the wax has been modified via a transgenic route, a breeding route, or a combination thereof.

3. The lubricant composition of claim 1, wherein the VLC FA is one or more of eicosenoic acid, erucic acid, or nervonic acid.

4. The lubricant composition of claim 1, wherein the VLC FA is erucic acid.

5. The lubricant composition of claim 1, further comprising a thickener.

6. The lubricant composition of claim 5, wherein the thickener is a soap selected from the group consisting of calcium stearate, sodium stearate, lithium stearate, lithium 12-hydroxystearate, and a combination thereof.

7. The lubricant composition of claim 5, wherein the thickener is a nanoclay.

8. The lubricant composition of claim 7, wherein the nanoclay is from about 1 wt % to about 20 wt % of a total weight of the lubricant composition.

9. The lubricant composition of claim 1, further comprising one or more additives selected from the group consisting of an antioxidant, an antiwear additive, a corrosion inhibitor, a detergent, a metal deactivator, a viscosity modifier, a dispersant.

10. The lubricant composition of claim 9, wherein the antioxidant is selected from the group consisting of (+)-α-tocopherol (TCP), propyl gallate (PG), l-ascorbic acid 6-palmitate (AP), 4,4'-methylenebis (2,6-di-tert-butylphenol) (MBP), butylated hydroxyl anisole (BHA), butylated hydroxyl toluene (BHT), propyl gallate (PG), tert-butyl hydroquinone (TBHQ), and a combination thereof.

11. The lubricant composition of claim 9, wherein the antiwear additive is selected from the group consisting of zinc dithiophosphate, zinc dialkyl dithiophosphate, tricresyl phosphate, dioleoyl phosphite, bis(2-ethylhexyl) phosphate, diphenyl cresyl phosphate, triphenyl phosphorothionate, chlorinated paraffins, glycerol monooleate, and a combination thereof.

12. The lubricant composition of claim 9, wherein the corrosion inhibitor is selected from the group consisting of a thiadiazole, a benzotriazole, a tolutriazole, a zinc dithiophosphate, a metal phenolate, a metal sulfonate, a fatty acid, a carboxylic acid, an amine, and a combination thereof.

13. The lubricant composition of claim 9, wherein the detergent is selected from the group consisting of a polyisobutylene succinimide, a polyisobutylene amine succinamide, an aliphatic amine, a polyolefin maleic anhydrides, and a combination thereof.

14. The lubricant composition of claim 9, wherein the metal deactivator is selected from the group consisting of a triazole, a tolyltriazole, a thiadiazole, and a combination thereof.

15. The lubricant composition of claim 9, wherein the viscosity modifier is selected from the group consisting of an ethylene-olefin co-polymer, a maleic anhydride-styrene alternating copolymer, a polymethacrylate, a hydrogenated styrene-butadiene copolymer, a hydrogenated styrene-isoprene copolymer, an ester thereof, and a combination thereof.

16. The lubricant composition of claim 9, wherein the dispersant is selected from the group consisting of succinimide, benzylamine, and a combination thereof.

17. The lubricant composition of claim 1, wherein the oil or the wax is extracted from a plant of the Brassicaceae family.

18. The lubricant composition of claim 1, wherein the oil or the wax is extracted from a plant selected from rapeseed, pennycress, canola, jojoba, palm, mustard, and a combination thereof.

19. A method for reducing friction in an engine or other mechanical device, comprising disposing the lubricant composition of claim 1 on at least one surface of the engine or other mechanical device.

20. The lubricant composition of claim 1, wherein the VLC FA comprises about 50% to about 80% by weight of the total weight of the oil or the wax.

* * * * *